US011620950B2

(12) United States Patent
Yang et al.

(10) Patent No.: US 11,620,950 B2
(45) Date of Patent: Apr. 4, 2023

(54) PIXEL DRIVING CIRCUIT, DRIVING METHOD, DISPLAY PANEL AND DISPLAY DEVICE

(71) Applicants: Wuhan Tianma Micro-Electronics Co., Ltd., Wuhan (CN); Wuhan Tianma Microelectronics Co., Ltd. Shanghai Branch, Shanghai (CN)

(72) Inventors: Shuai Yang, Shanghai (CN); Xingyao Zhou, Shanghai (CN); Yue Li, Shanghai (CN); Mengmeng Zhang, Shanghai (CN)

(73) Assignees: WUHAN TIANMA MICRO-ELECTRONICS CO., LTD., Wuhan (CN); WUHAN TIANMA MICROELECTRONICS CO., LTD. SHANGHAI BRANCH, Shanghai (CN)

( * ) Notice: Subject to any disclaimer, the term of this patent is extended or adjusted under 35 U.S.C. 154(b) by 0 days.

(21) Appl. No.: 17/405,643

(22) Filed: Aug. 18, 2021

(65) Prior Publication Data

US 2022/0310016 A1 Sep. 29, 2022

(30) Foreign Application Priority Data

Mar. 23, 2021 (CN) ..... 202110310898.2

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/3266* (2013.01); *G09G 3/3291* (2013.01); *G09G 3/3233* (2013.01); *G09G 2300/0876* (2013.01)

(58) Field of Classification Search
CPC .. G09G 3/3208; G09G 3/3233; G09G 3/3258; G09G 3/3266; G09G 3/3291;
(Continued)

(56) References Cited

U.S. PATENT DOCUMENTS

2015/0035448 A1* 2/2015 Wang ..... G09G 3/3291 315/240
2015/0364092 A1* 12/2015 Kim ..... G09G 3/3233 345/82

(Continued)

FOREIGN PATENT DOCUMENTS

CN 102930824 A 2/2013
CN 103247262 A 8/2013
CN 111445858 A 7/2020

*Primary Examiner* — Michael J Eurice
(74) *Attorney, Agent, or Firm* — Anova Law Group, PLLC

(57) ABSTRACT

A pixel driving circuit, a driving method, a display panel and a display device are provided. The pixel driving circuit include a driving module, configured to drive a light-emitting element to emit light, wherein a control terminal of the driving module is electrically connected to a first node, and a first terminal is electrically connected to a second node; a data writing module, configured to write data signals, wherein a control terminal of the data writing module is electrically connected with a first scan signal line, and a first terminal is electrically connected with a data signal terminal; and a coupling module, configured to couple the data signals to the first terminal of the driving module, wherein a first terminal of the coupling module is electrically connected to a second terminal of the data writing module, and a second terminal is electrically connected to the second node.

27 Claims, 20 Drawing Sheets

(51) Int. Cl.
*G09G 3/3266* (2016.01)
*G09G 3/3291* (2016.01)

(58) Field of Classification Search
CPC ... G09G 2300/0852; G09G 2300/0819; G09G 2300/0876; G09G 2310/061; G09G 2310/08; G09G 2320/0233; G09G 2320/0295; G09G 2320/045
See application file for complete search history.

(56) References Cited

U.S. PATENT DOCUMENTS

| | | | | |
|---|---|---|---|---|
| 2021/0256908 | A1* | 8/2021 | Park | G09G 3/3275 |
| 2021/0366386 | A1* | 11/2021 | Gao | G09G 3/3258 |
| 2022/0230592 | A1* | 7/2022 | Zhao | G09G 3/3258 |

* cited by examiner

PIXEL DRIVING CIRCUIT, DRIVING METHOD, DISPLAY PANEL AND DISPLAY DEVICE

CROSS-REFERENCE TO RELATED APPLICATION

This application claims the priority of Chinese Patent Application No. 202110310898.2, filed on Mar. 23, 2021, the content of which is incorporated by reference in its entirety.

TECHNICAL FIELD

The present disclosure generally relates to the field of display technology and, more particularly, relates to a pixel driving circuit, a driving method, a display panel and a display device.

BACKGROUND

Organic light-emitting diode (OLED) display panels have the advantages of high visibility, high brightness, and lighter weight. Therefore, OLED display panels are more and more widely used.

An OLED display panel generally includes a number of pixels, and each pixel includes a light-emitting element electrically connected to a pixel driving circuit. The transistors in the pixel driving circuit can generate a driving current, and the light-emitting element emits light in response to the driving current output by the pixel driving circuit.

However, when the related pixel driving circuit drives the light-emitting element to emit light, the brightness of the light-emitting element is often inconsistent with the expected normal brightness, and there may be a poor display quality issue. The disclosed driving circuits, driving methods, display panels and display devices are directed to solve one or more problems set forth above and other problems in the art.

SUMMARY

One aspect of the present disclosure provides a pixel driving circuit. The pixel driving circuit may include a driving module, configured to drive a light-emitting element to emit light, wherein a control terminal of the driving module is electrically connected to a first node, and a first terminal of the driving module is electrically connected to a second node; a data writing module, configured to write data signals, wherein a control terminal of the data writing module is electrically connected to a first scan signal line, and a first terminal of the data writing module is electrically connected to a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node.

Another aspect of the present disclosure provides a pixel driving method. The pixel driving method may include providing a pixel driving circuit. The pixel driving circuit may include a driving module, configured to drive a light-emitting element to emit light, wherein a control terminal of the driving module is electrically connected to a first node, and a first terminal of the driving module is electrically connected to a second node; a data writing module, configured to write data signals, wherein a control terminal of the data writing module is electrically connected to a first scan signal line, and a first terminal of the data writing module is electrically connected to a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node. Further, the method may include, in a data writing stage, turning on the data writing module under a control of a first scan signal output by the first scan signal line, and coupling the data signal output by the data signal terminal to the first terminal of the drive module.

Another aspect of the present disclosure provides a display panel. The display panel may include a pixel driving circuit. The pixel driving circuit may include a driving module, configured to drive a light-emitting element to emit light, wherein a control terminal of the driving module is electrically connected to a first node, and a first terminal of the driving module is electrically connected to a second node; a data writing module, configured to write data signals, wherein a control terminal of the data writing module is electrically connected to a first scan signal line, and a first terminal of the data writing module is electrically connected to a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node.

Another aspect of the present disclosure provides a display device. The display device may include a display panel. The display panel may include a pixel driving circuit. The pixel driving circuit may include a driving module, configured to drive a light-emitting element to emit light, wherein a control terminal of the driving module is electrically connected to a first node, and a first terminal of the driving module is electrically connected to a second node; a data writing module, configured to write data signals, wherein a control terminal of the data writing module is electrically connected with a first scan signal line, and a first terminal of the data writing module is electrically connected to a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node.

Other aspects of the present disclosure can be understood by those skilled in the art in light of the description, the claims, and the drawings of the present disclosure.

BRIEF DESCRIPTION OF THE DRAWINGS

To explain the technical solutions of the embodiments of the present disclosure more clearly, the following will briefly introduce the drawings needed in the embodiments of the present disclosure. For those of ordinary skill in the art, without a creative work, other drawings can be obtained based on these drawings.

DETAILED DESCRIPTION

Figure 1:
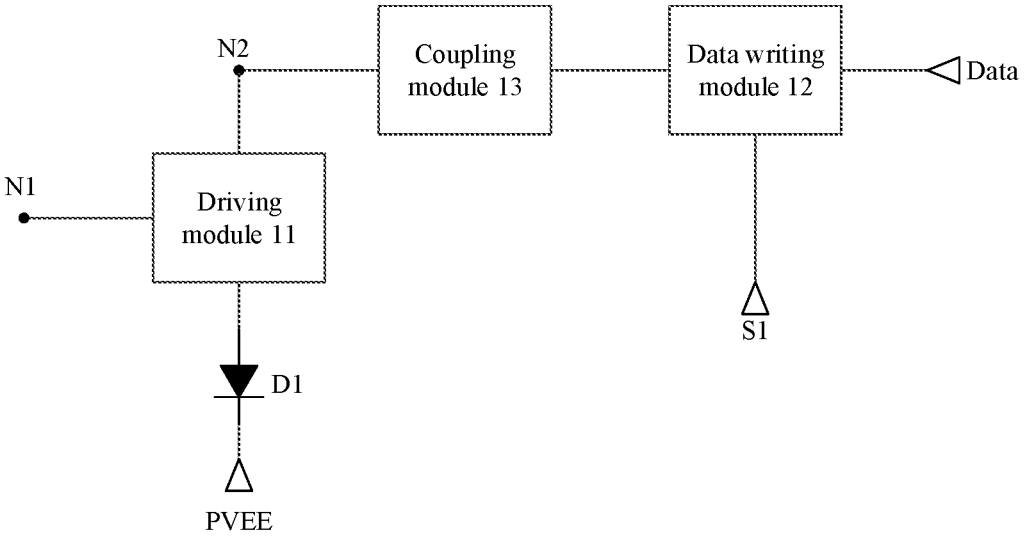
FIG. 1 illustrates an exemplary pixel driving circuit according to various disclosed embodiments of the present disclosure.

The features and exemplary embodiments of various aspects of the present disclosure will be described in detail below. In the following detailed description, many specific details are proposed to provide a comprehensive understanding of the present disclosure. However, it is obvious to those skilled in the art that the present disclosure can be implemented without some of these specific details. The following description of the embodiments is only to provide a better understanding of the present disclosure by showing examples of the present disclosure.

It should be noted that in this disclosure, relational terms, such as first and second, are only used to distinguish one entity or operation from another entity or operation, and do not necessarily require or imply one of these entities or operations to have any such actual relationship or order between. Moreover, the terms “include”, “containing” or any other variants thereof are intended to cover non-exclusive inclusion, such that a process, method, article or device including a series of elements not only includes those elements, but also includes those that are not explicitly listed, or also include elements inherent to this process, method, article or equipment. If there are no more restrictions, the elements defined by the sentence "including . . . " do not exclude the existence of other identical elements in the process, method, article, or equipment that includes the elements.

The term "and/or" used in this disclosure is only an association relationship describing associated objects, indicating that there can be three types of relationships. For example, A and/or B can mean that A alone exists, and both A and B exist at the same time and B exists alone. In addition, the character "/" in this text generally indicates that the associated objects before and after are in an "or" relationship.

The transistors in the embodiments of the present disclosure are described by using P-type transistors as an example, but they are not limited to P-type transistors and can also be replaced with N-type transistors. For P-type transistors, the turn-on level is a low level, and the turn-off level is a high level. For example, when the control terminal of the P-type transistor is extremely low, the first terminal and the second terminal may be turned on for a conduction, and when the control terminal of the P-type transistor is high, the first terminal and the second terminal may be turned off for a disconnection. In specific implementation, the gate electrode of each transistor may be used as its control terminal, and according to the signal and type of the gate electrode of each transistor, the first terminal can be used as the source electrode and the second terminal may be used as the drain electrode, or the first terminal may be used as a drain electrode, and the second terminal may be used as a source electrode, and no distinction is made here. In addition, the turn-on level and the turn-off level in the embodiment of the present disclosure may refer to both in general, and the turn-on level refers to anything that can turn on the transistor for a conduction. The turn-off level refers to any level that can turn off/shut of the transistor for a disconnection.

In the embodiments of the present disclosure, the term "electrical connection" may refer to the direct electrical connection of two components, or may refer to the electrical connection between the two components via one or more other components.

In the embodiment of the present disclosure, the first node and the second node are only defined for the convenience of describing the circuit structure, and the first node and the second node may not be an actual circuit unit.

It is obvious to those skilled in the art that various modifications and changes can be made in this disclosure without departing from the spirit or scope of this disclosure. Therefore, this disclosure intends to cover the amendments and changes of this application that fall within the scope of the corresponding claims (claimed technical solutions) and their equivalents. It should be noted that the implementation manners provided in the embodiments of the present disclosure can be combined with each other if there is no contradiction.

Before describing the technical solutions provided by the embodiments of the present disclosure, to facilitate the understanding of the embodiments of the present disclosure, the present disclosure first specifically explains the problems existing in the related technologies.

As mentioned above, an OLED display panel generally includes a number of pixels, and each pixel includes a light-emitting element electrically connected to a pixel driving circuit. The data writing module in the related pixel driving circuit is usually connected to the control terminal of the driving module. When the light-emitting element is driven to emit light, the leakage current of the data writing module will affect the potential of the control terminal of the driving module. For example, the potential of the control terminal of the driving module will be lowered, and the brightness of the light-emitting element will be lower than the expected normal brightness, and the problems of dark screen brightness and poor display will occur.

The present disclosure provides a pixel driving circuit, a driving method, a display panel, and a display device. The following first describe the pixel driving circuit provided by the embodiments of the present disclosure.

FIG. 1 is a schematic circuit diagram of an exemplary pixel driving circuit provided by an embodiment of the present disclosure. As shown in FIG. 1, the pixel driving circuit may include a driving module 11. The pixel driving module may be configured to drive a light-emitting element D1 to emit light. A control terminal of the driving module 11 may be electrically connected to a first node N1, and a first terminal of the driving module 11 may be electrically connected to a second node N2.

The pixel driving circuit may also include a data writing module 12. The data wiring module 12 may be configured to writing data signals. A control terminal of the data writing module 12 may be electrically connected to a first scan signal line S1, and a first terminal of the data writing module 12 may electrically connected to a data signal terminal Data.

Further, the pixel driving circuit may include a coupling module 13. The coupling module may be configured to couple the data signals to the first terminal of the driving module 11. A first terminal of the coupling module 13 may be electrically connected to the second terminal of the data writing module 12, and a second terminal of the coupling module 13 may be electrically connected to the second node N2.

The pixel driving circuit of the embodiment of the present disclosure may provide a new data signal writing method. The data writing module 12 may be connected to the first terminal of the driving module 11, and the data writing module 12 and the driving module 11 may also be connected to each other. Further, a coupling module 13 may be provided. In a data writing stage, the data signals written by the data writing module 12 may be coupled to the first terminal of the driving module 11 through the coupling module 13, and the coupling module 13 may perform a voltage division during a light-emitting stage to reduce the effect of the data signal caused by the input of the leakage current to the potential of the control terminal of the drive module 11. Accordingly, the potential of the control terminal of the driving module 11 may be maintained within a preset threshold range, the light-emitting element may be ensured to emit light normally, and the problem of the poor display caused by that the brightness of the light-emitting element is inconsistent with the expected normal brightness may be solved.

Figure 2:
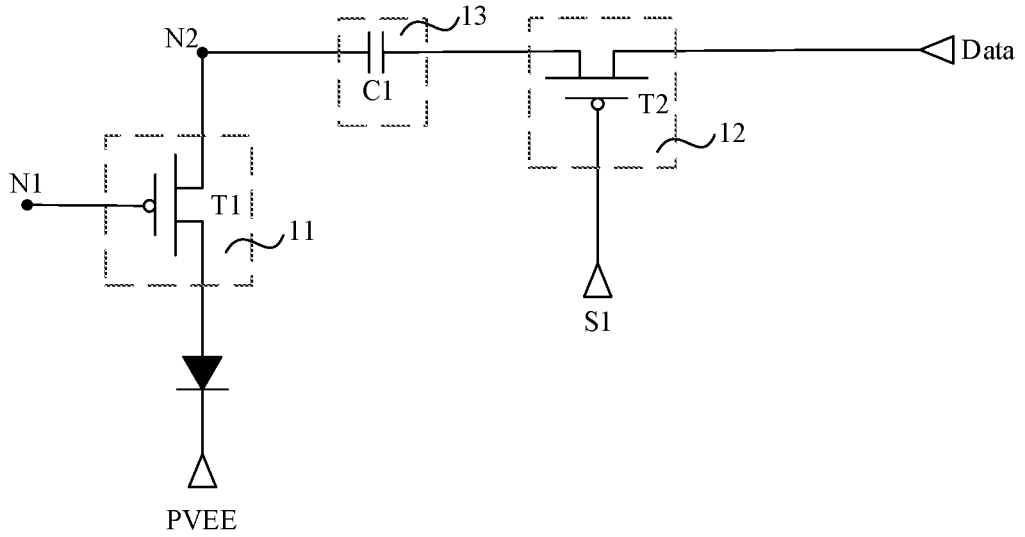
FIG. 2 illustrates another exemplary pixel driving circuit according to various disclosed embodiments of the present disclosure.

FIG. 2 is a schematic circuit diagram of another exemplary pixel driving circuit according to one embodiment of the present disclosure. As shown in FIG. 2, the driving module 11 may include a first transistor T1; the data writing module 12 may include a second transistor T2; and the coupling module 13 may include a coupling capacitor C1. A control terminal of the first transistor T1 may be electrically connected to the first node N1, and a first terminal of the first transistor T1 may be electrically connected to the second node N2.

A control terminal of the second transistor T2 may be electrically connected to the first scan signal line S1; a first terminal of the second transistor T2 may be electrically connected to the data signal terminal Data; and a second terminal of the second transistor T2 may be electrically connected to the first plate of the coupling capacitor C1. The second plate of the coupling capacitor C1 may be electrically connected to the second node N2.

In a data writing stage t2, the second transistor T2 may be turned on under the control of the first scan signal output by the first scan signal line S1; and the data signals written by the second transistor T2 may be coupled to the first terminal of the first transistor T1 through the coupling capacitor C1. In a light-emitting stage t3, the coupling capacitor C1 may divide the data signal leaked by the second transistor T2 to reduce the influence of the data signal input due to the leakage current on the potential of the control terminal of the first transistor T1. Accordingly, the potential of the control terminal of the first transistor T1 may be maintained within the preset threshold range to ensure that the light-emitting element may emit light normally. Thus, the technical problems of the inconsistency between the brightness of the light-emitting element and the expected normal brightness and the poor display may be solved.

Due to the process deviations, the threshold voltage Vth of the thin-film transistor (TFT) on the OLED display panel may shift. Accordingly, the uneven currents in different pixels may occur; and the panel display may display unevenly.

Figure 3:
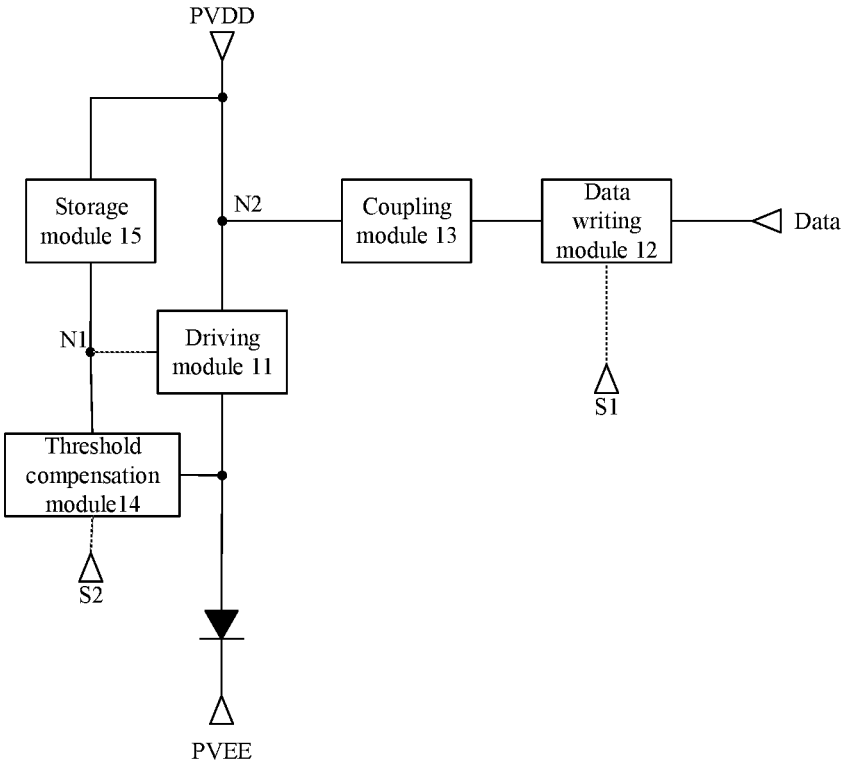
FIG. 3 illustrates another exemplary pixel driving circuit according to various disclosed embodiments of the present disclosure.

FIG. 3 illustrates another exemplary pixel driving circuit according to various disclosed embodiments of the present disclosure. As shown in FIG. 3, to compensate for the threshold voltage shift (Vth Shift) caused by the non-uniformity of the TFT and ensure the uniformity of the current of different pixels, the pixel driving circuit may also include a threshold compensation module 14. A control terminal of the threshold compensation module 14 may be electrically connected to the second scan signal line S2; a first terminal of the threshold compensation module 14 may be electrically connected to the first node N1; and a second terminal of the threshold compensation module 14 may be electrically connected to the second terminal of the driving module 11.

Further, the pixel driving circuit may include a storage module 15. The storage module may be configured to maintain the potential of the first node N1. A first terminal of the storage module 15 may be electrically connected to the first node N1; and the second terminal of the storage module 15 may be electrically connected to the first power supply voltage signal terminal PVDD.

For example, in the data writing stage t2 (also known as the "threshold compensation stage"), the data writing module 12 may be turned on under the control of the first scan signal output by the first scan signal line S1; the threshold compensation module 14 may be turned on under the control of the second scan signal output by the second scan signal line S2; and the driving module 11 may be turned on under the control of the first node N1. The data signal written by the data writing module 12 may be coupled to the first terminal of the driving module 11 through the coupling module 13; the threshold compensation module 14 may be turned on for a conduction to drive the control terminal of the driving module 11 and the second terminal of the driving module 11; and the storage module 15 may maintain the potential of the control terminal of the driving module 11. Under the action of the data signal, the potential of the control terminal of the driving module 11 may be adjusted to a target voltage value. The target voltage value may be the difference between the voltage value of the first terminal of the driving module 11 and the threshold voltage Vth of the driving module 11, for example, the potential VN1=VN2−Vth of the control terminal of the drive module 11 in the data writing stage. VN2 represents the voltage value of the first terminal (i.e., the second node N2) of the driving module 11. Therefore, the embodiment of the present disclosure may couple the data signal written by the data writing module to the first terminal of the drive module through the coupling module, and then may use the data signal input from the first terminal of the drive module to perform the threshold compensation. Accordingly, the threshold compensation of the driving TFT may be realized; and the influence of the threshold voltage Vth on the driving current of the pixel may be eliminated. Thus, the uniformity of the display panel may be ensured, and the display effect may be improved.

Figure 4:
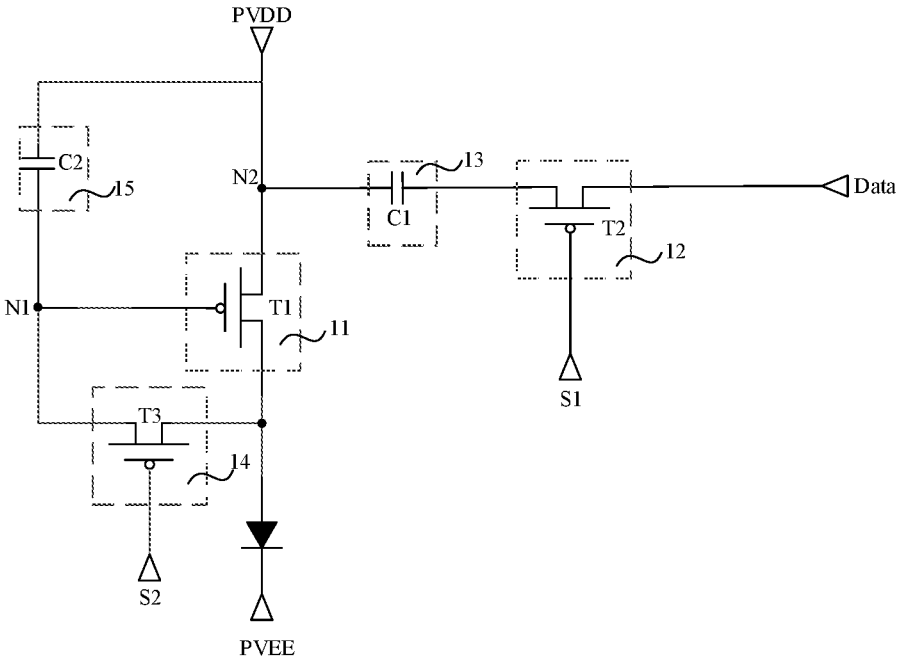
FIG. 4 illustrates another exemplary pixel driving circuit according to various disclosed embodiments of the present disclosure.

FIG. 4 is a schematic circuit diagram of another exemplary pixel driving circuit according to various disclosed embodiments of the present disclosure. As shown in FIG. 4, the threshold compensation module 14 may include a third transistor T3, and the storage module 15 may include a storage capacitor C2. The control terminal of the third transistor T3 may be electrically connected to the second scan signal line S2; the first terminal of the third transistor T3 may be electrically connected to the first node N1; and the second terminal of the third transistor T3 may be electrically connected to the second terminal of the first transistor T1. The first plate of the storage capacitor C2 may be electrically connected to the first node N1; and the second plate of the storage capacitor C2 may be electrically connected to the first power voltage signal terminal PVDD.

In the data writing stage t2, the third transistor T3 may be turned on under the control of the second scan signal output by the second scan signal line S2; the third transistor T3 may turn on the control terminal (the first node N1) of the first transistor T1 and the second terminal of the first transistor T1; the first transistor T1 may be turned on under the control of the first node N1; and the first transistor T1, the third transistor T3 and the storage capacitor C2 may form a loop. The second transistor T2 may be turned on under the control of the first scan signal output by the first scan signal line S1; and the data signal may be coupled to the first terminal of the first transistor T1 through the coupling capacitor C1. The first transistor T1 may capture the threshold value; and the potential of the control terminal of the first transistor T1 may be adjusted to VN1=VN2−Vth. Accordingly, the threshold voltage Vth of the first transistor T1 may be compensated; the influence of the threshold voltage Vth on the driving current of the pixel may be eliminated; the uniformity of the display panel may be ensured; and the display effect may be improved.

The first scan signal line S1 and the second scan signal line S2 may be different scan signal lines, but in some embodiments, the first scan signal line S1 may also be multiplexed with the second scan signal line S2. For example, the first scan signal line S1 and the second scan signal line S2 may be a same scan signal line, and the control terminal of the second transistor T2 and the control terminal of the third transistor T3 may be connected to the same scan signal line. Specific examples will be described below.

Figure 5:
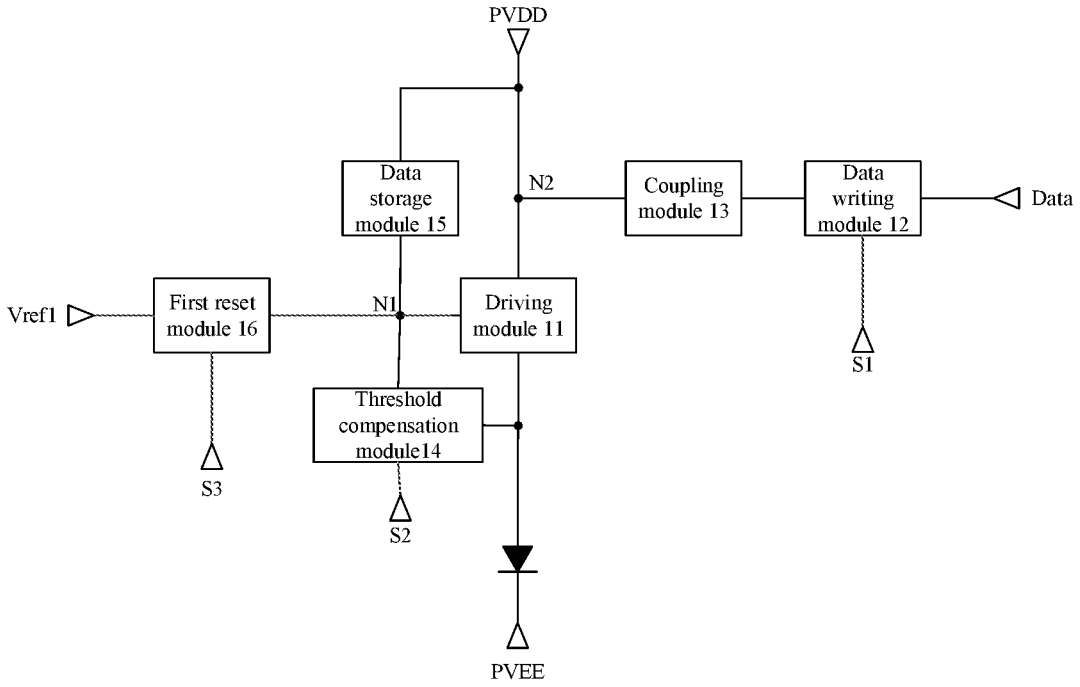
FIG. 5 illustrates another exemplary pixel driving circuit according to various disclosed embodiments of the present disclosure.

FIG. 5 is a schematic circuit diagram of another exemplary pixel driving circuit according to various disclosed embodiments of the present disclosure. As shown in FIG. 5, to enable the first node N1 to successfully write the expected voltage value each time, the pixel driving circuit may further include a first reset module 16. The first reset module may be configured to reset the first node N1.

The control terminal of the first reset module 16 may be electrically connected to the third scan signal line S3; the first terminal of the first reset module 16 may be electrically connected to the first reference voltage signal terminal Vref1; and the control terminal of the first reset module 16 may be electrically connected to the first reference voltage signal terminal Vref1. The second terminal of the first reset module 16 may be electrically connected to the first node N1. For example, in the initialization stage t1, the first reset module 16 may be turned on under the control of the third scan signal output by the third scan signal line S3; and the first reference voltage signal output by the first reference voltage signal terminal Vref1 may reset the first node N1. By resetting the first node N1, the first node N1 may be pulled down to a lower potential, thereby ensuring that the first node N1 may be successfully written when the expected voltage value is subsequently written to the first node N1.

Figure 6:
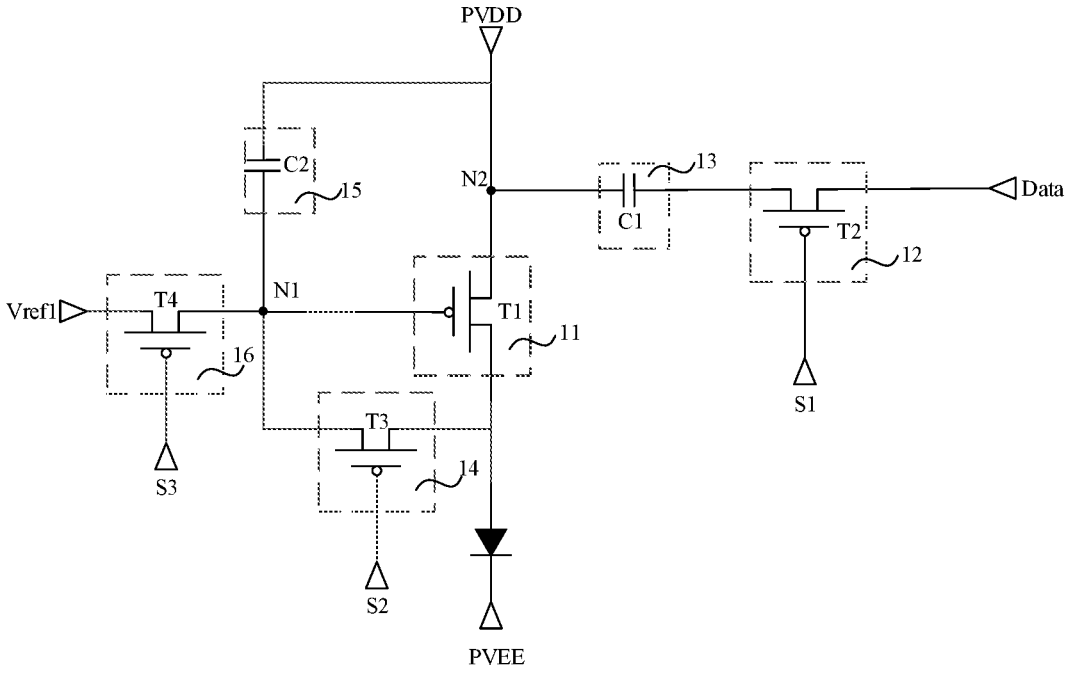
FIG. 6 illustrates another exemplary pixel driving circuit according to various disclosed embodiments of the present disclosure.

FIG. 6 is a schematic circuit diagram of another exemplary pixel driving circuit according to various disclosed embodiments of the present disclosure. As shown in FIG. 6, the first reset module 16 may include a fourth transistor T4. The control terminal of the fourth transistor T4 may be electrically connected to the third scan signal line S3; the first terminal of the fourth transistor T4 may be electrically connected to the first reference voltage signal terminal Vref1; and the second electrode of the fourth transistor T4 may be electrically connected to the first node N1. For example, in the initialization stage t1, the fourth transistor T4 may be turned on under the control of the third scan signal output by the third scan signal line S3; and the first reference voltage signal output by the first reference voltage signal terminal Vref1 may reset the first node N1. By resetting the first node N1, the first node N1 may be pulled down to a lower potential, thereby ensuring that the first node N1 may be successfully written when the expected voltage value is subsequently written to the first node N1.

Figure 7:
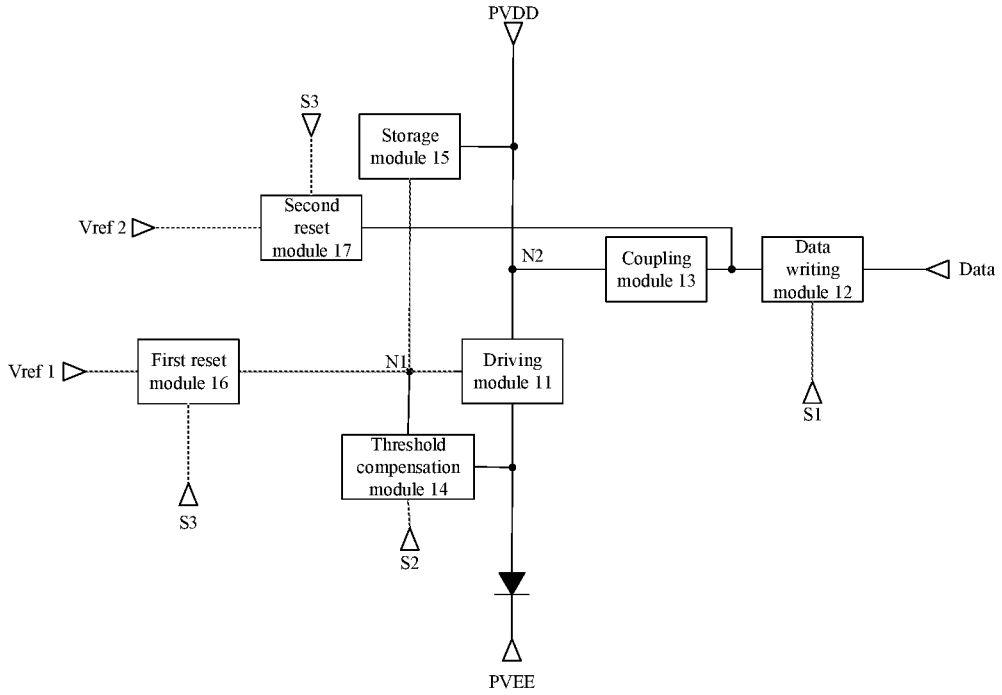
FIG. 7 illustrates another exemplary pixel driving circuit according to various disclosed embodiments of the present disclosure.

FIG. 7 is a schematic circuit diagram of another exemplary pixel driving circuit according to various disclosed embodiments of the present disclosure. As shown in FIG. 7, to ensure that the data signals may be successfully coupled to the first terminal of the driving module 11 and avoid a smear phenomenon, the pixel driving circuit may further include a second reset module 17. The second reset module may be configured to the reset the first terminal of the coupling module 13.

The control terminal of the second reset module 17 may be electrically connected to the third scan signal line S3; the first terminal of the second reset module 17 may be electrically connected to the second reference voltage signal terminal Vref2; and the second terminal of the reset module 17 may be coupled to the first terminal of the coupling module 13. For example, in the initialization stage t1, the second reset module 17 may be turned on under the control of the third scan signal output by the third scan signal line S3, and the second reference voltage signal output by the second reference voltage signal terminal Vref2 may reset the first terminal of the coupling module 13. By resetting the first terminal of the coupling module 13, the first terminal of the coupling module 13 may be pulled down to a lower potential, thereby ensuring that subsequent data signals may be successfully coupled to the first terminal of the driving module 11 through the coupling module 13; and the smear phenomenon may be avoided.

The second reference voltage signal terminal Vref2 may be multiplexed with the first reference voltage signal terminal Vref1. For example, the first terminal of the second reset module 17 may be connected to the first reference voltage signal terminal Vref1; and the first terminal of the coupling module 13 may be reset by using the first reference voltage signal output from the first reference voltage signal terminal Vref1.

Figure 8:
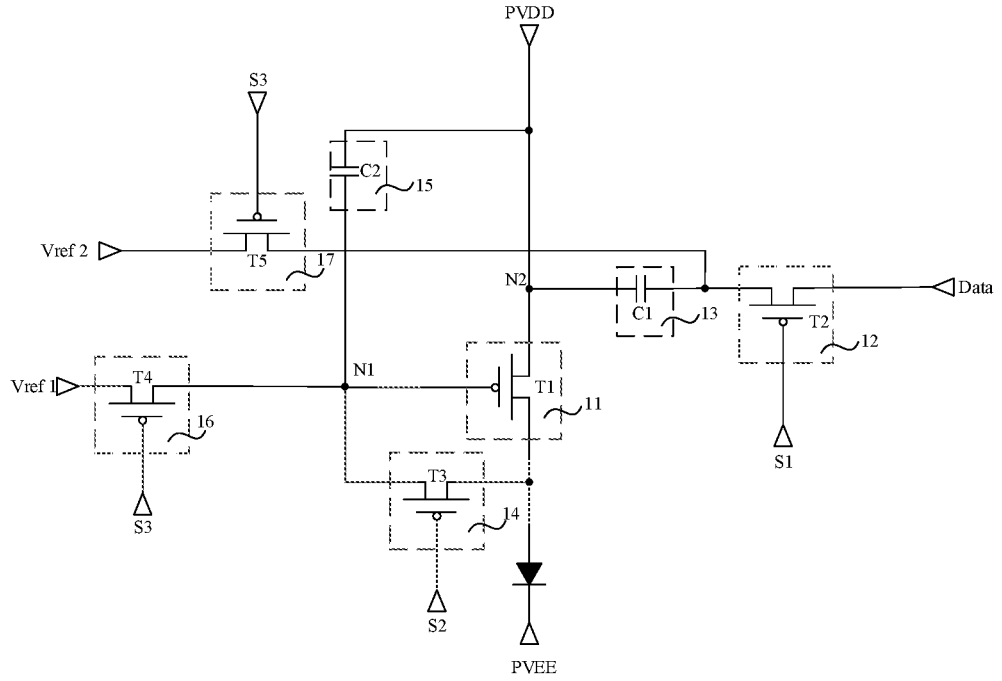
FIG. 8 illustrates another exemplary pixel driving circuit according to various disclosed embodiments of the present disclosure.

FIG. 8 is a schematic circuit diagram of another exemplary pixel driving circuit according to various disclosed embodiments of the present disclosure. As shown in FIG. 8, the second reset module 17 may include a fifth transistor T5. The control terminal of the fifth transistor T5 may be electrically connected to the third scan signal line S3; the first terminal of the fifth transistor T5 may be electrically connected to the second reference voltage signal terminal Vref2; and the second terminal of the fifth transistor T5 may be electrically connected to the first terminal of the coupling module 13. For example, the second terminal of the fifth transistor T5 may be electrically connected to the first plate of the coupling capacitor C1. In the initialization stage t1, the fifth transistor T5 may be turned on under the control of the third scan signal output by the third scan signal line S3; and the second reference voltage signal output by the second reference voltage signal terminal Vref2 may reset the first plate of the coupling capacitor C1. By resetting the first plate of the coupling capacitor C1, the first plate of the coupling capacitor C1 may be pulled down to a lower potential, thereby ensuring that subsequent data signals may be successfully coupled to the first transistor T1 through the coupling capacitor C1; and the smear phenomenon may be avoided.

Figure 9:
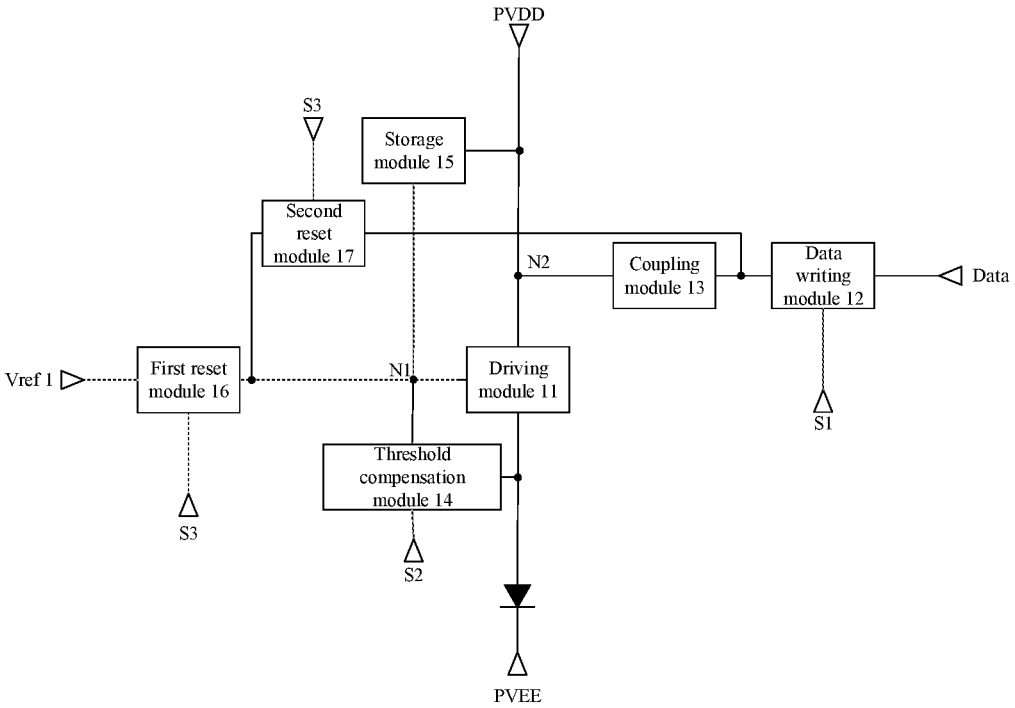
FIG. 9 illustrates another exemplary pixel driving circuit according to various disclosed embodiments of the present disclosure.

FIG. 9 is a schematic circuit diagram of another exemplary pixel driving circuit according to various disclosed embodiments of the present disclosure. The major difference from FIG. 7 may include that the first terminal of the second reset module 17 shown in FIG. 9 may be electrically connected to the second terminal of the first reset module 16, and the first reference voltage signal output by the first reference voltage signal terminal Vref1 may reset the first terminal of the coupling module 13 by sequentially passing through the first reset module 16 and the second reset module 17.

As shown in FIG. 9, the control terminal of the second reset module 17 may be electrically connected to the third scan signal line S3; the first terminal of the second reset module 17 may be electrically connected to the second terminal of the first reset module 16; and the second terminal of the second reset module 17 may be electrically connected to the first terminal of the coupling module 13 for resetting the first terminal of the coupling module 13. For example, in the initialization stage t1, the first reset module 16 may be turned on under the control of the third scan signal output by the third scan signal line S3; the second reset module 17 may be turned on under the control of the third scan signal output by the third scan signal line S3; and the first reference voltage signal may reset the first terminal of the coupling module 13 sequentially through the first reset module 16 and the second reset module 17. By resetting the first terminal of the coupling module 13, the first terminal of the coupling module 13 may be pulled down to a lower potential, thereby ensuring that subsequent data signals may be successfully coupled to the first terminal of the driving module 11 through the coupling module 13; and the smear phenomenon may be avoided.

Figure 10:
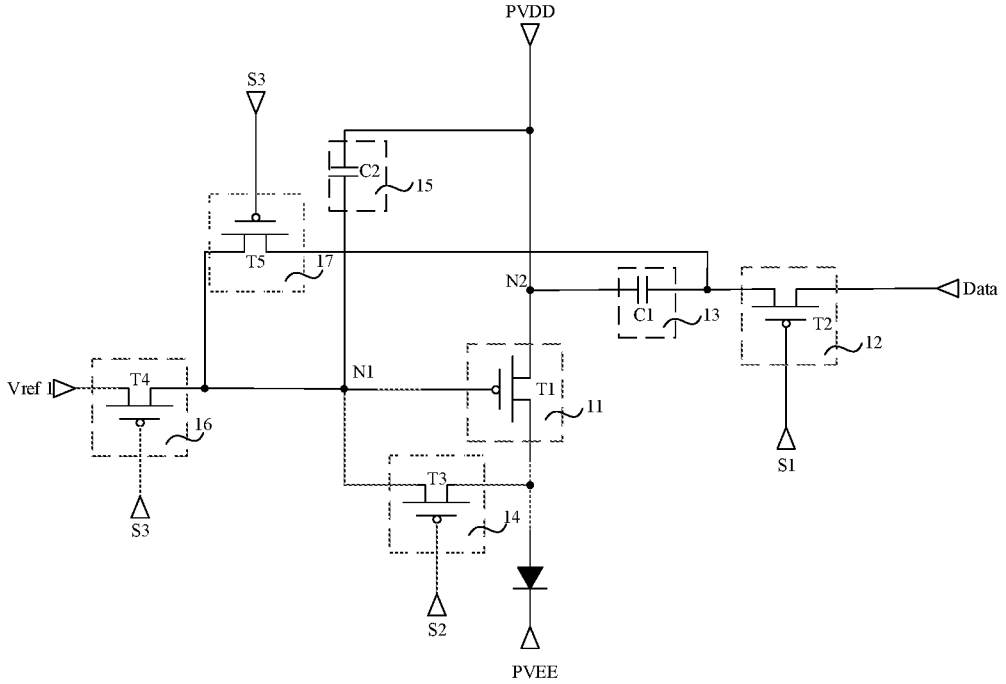
FIG. 10 illustrates another exemplary pixel driving circuit according to various disclosed embodiments of the present disclosure.

FIG. 10 is a schematic circuit diagram of another exemplary pixel driving circuit according to various disclosed embodiments of the present disclosure. As shown in FIG. 10, corresponding to the second reset module 17 shown in FIG. 9, the second reset module 17 may include a fifth transistor T5. The control terminal of the fifth transistor T5 may be electrically connected to the third scan signal line S3. The first terminal of fifth transistor T5 may be electrically connected to the second terminal of the first reset module 16; and the second terminal of the fifth transistor T5 may be electrically connected to the first terminal of the coupling module 13. For example, the control terminal of the fifth transistor T5 may be electrically connected to the third scan signal line S3; the first terminal of the fifth transistor T5 may be electrically connected to the second terminal of the fourth transistor T4; and the second terminal of the fifth transistor T5 may be electrically connected to the first plate of the coupling capacitor C1. In the initialization stage t1, the fourth transistor T4 may be turned on under the control of the third scanning signal output by the third scanning signal line S3; and the fifth transistor T5 may be turned on under the control of the third scanning signal output by the third scanning signal line S3. The first reference voltage signal may reset the first plate of the coupling capacitor C1 sequentially through the fourth transistor T4 and the fifth transistor T5. By resetting the first plate of the coupling capacitor C1, the first plate of the coupling capacitor C1 may be pulled down to a lower potential, thereby ensuring that subsequent data signals may be successfully coupled to the first terminal of the first transistor T1 through the coupling capacitor C1, and the smear phenomenon may be avoided.

Figure 11:
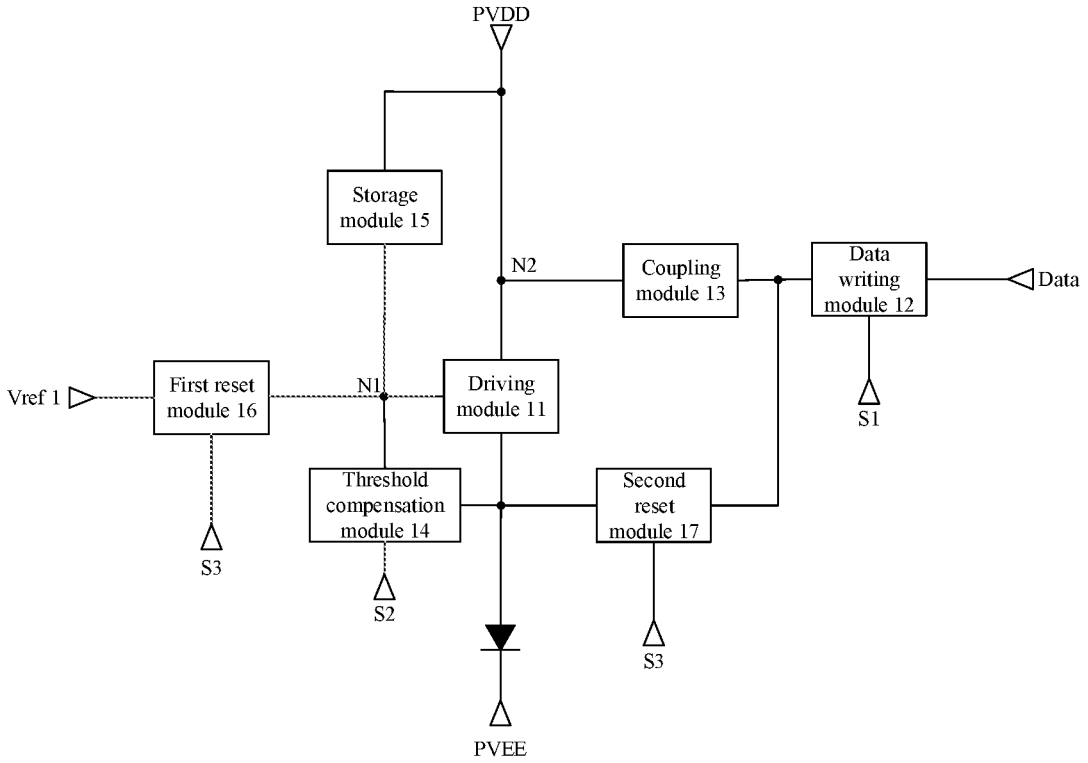
FIG. 11 illustrates another exemplary pixel driving circuit according to various disclosed embodiments of the present disclosure.

FIG. 11 is a schematic circuit diagram of another exemplary pixel driving circuit according to various disclosed embodiments of the present disclosure. As shown in FIG. 11, the difference from FIG. 7 may include that the first terminal of the second reset module 17 shown in FIG. 11 may be electrically connected to the second terminal of the threshold compensation module 14, and the first reference voltage signal output by the first reference voltage signal terminal Vref1 may reset the coupling module 13 sequentially through the first reset module 16, the threshold compensation module 14 and the second reset module 17.

As shown in FIG. 11, the control terminal of the second reset module 17 may be electrically connected to the third scan signal line S3; the first terminal of the second reset module 17 may be electrically connected to the second terminal of the threshold compensation module 14; and the second terminal of the second reset module 17 may be electrically connected to the first terminal of the coupling module 12 for resetting the first terminal of the coupling module 12. For example, in the initialization stage t1, the first reset module 16 may be turned on under the control of the third scan signal output by the third scan signal line S3; the threshold compensation module 14 may be turned on under the control of the second scan signal output by the second scan signal line S2; and the second reset module 17 may be turned on under the control of the third scan signal output by the third scan signal line S3. The first reference voltage signal may reset the coupling module 13 sequentially through the first reset module 16, the threshold compensation module 14, and the second reset module 17. By resetting the first terminal of the coupling module 13, the first terminal of the coupling module 13 may be pulled down to a lower potential, thereby ensuring that subsequent data signals may be successfully coupled to the first terminal of the driving module 11 through the coupling module 13; and the smear phenomenon may be avoided.

Figure 12:
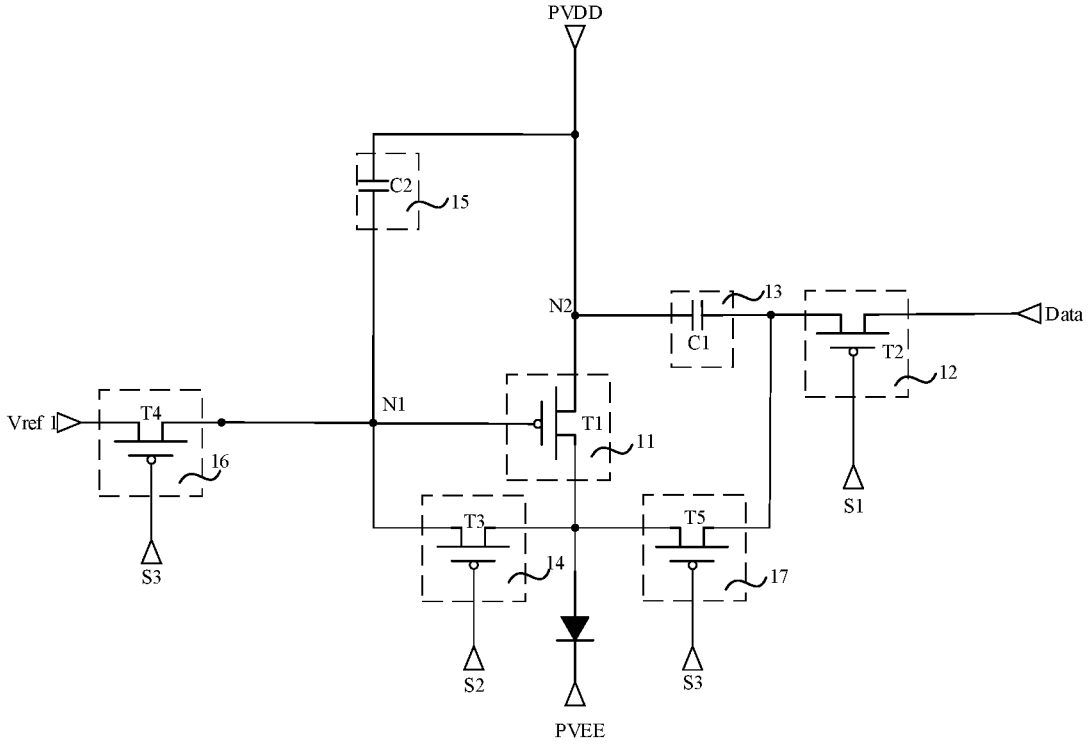
FIG. 12 illustrates another exemplary pixel driving circuit according to various disclosed embodiments of the present disclosure.

FIG. 12 is a schematic circuit diagram of another exemplary pixel driving circuit according to various disclosed embodiments of the present disclosure. As shown in FIG. 12, corresponding to the second reset module 17 shown in FIG. 11, the second reset module 17 may include a fifth transistor T5. The control terminal of the fifth transistor T5 may be electrically connected to the third scan signal line S3. The first terminal of the fifth transistor T5 may be electrically connected to the second terminal of the threshold compensation module 14; and the second terminal of the fifth transistor T5 may be electrically connected to the first terminal of the coupling module 13. For example, the control terminal of the fifth transistor T5 may be electrically connected to the third scan signal line S3; the first terminal of the fifth transistor T5 may be electrically connected to the second terminal of the third transistor T3; and the second terminal of the fifth transistor T5 may be electrically connected to the first plate of the coupling capacitor C1. In the initialization stage t1, the fourth transistor T4 may be turned on under the control of the third scanning signal output by the third scanning signal line S3; the third transistor T3 may be turned on under the control of the second scanning signal output by the second scanning signal line S2; the fifth transistor T5 may be turned on under the control of the third scan signal output by the third scan signal line S3; and the first reference voltage signal may reset the first plate of the coupling capacitor C1 sequentially through the fourth transistor T4, the third transistor T3, and the fifth transistor T5. By resetting the first plate of the coupling capacitor C1, the first plate of the coupling capacitor C1 may be pulled down to a lower potential, thereby ensuring that subsequent data signals may be successfully coupled to the first terminal of the first transistor T1 through the coupling capacitor C1; and the smear phenomenon may be avoided.

Figure 13:
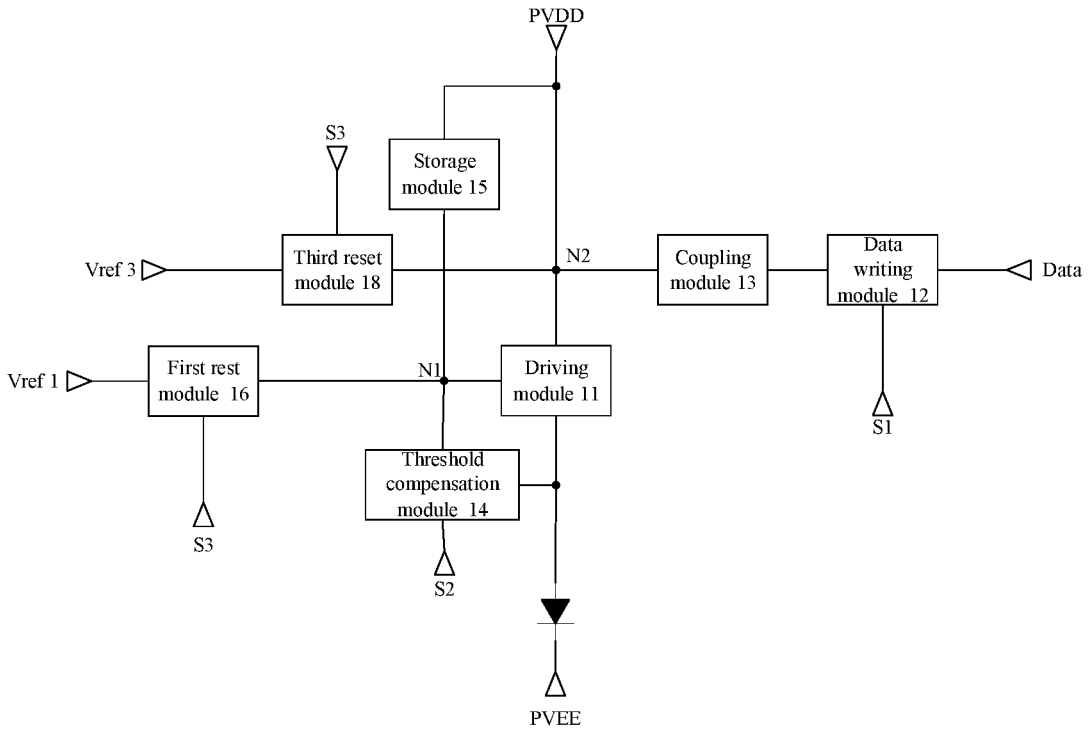
FIG. 13 illustrates another exemplary pixel driving circuit according to various disclosed embodiments of the present disclosure.

FIG. 13 is a schematic circuit diagram of another exemplary pixel driving circuit according to various disclosed embodiments of the present disclosure. As shown in FIG. 13, to enable the second node N2 to successfully write the expected voltage value each time, the pixel driving circuit may further include a third reset module 18. The third reset module 18 may be configured to reset the second node N2.

The control terminal of the third reset module 18 may be electrically connected to the third scan signal line S3; the first terminal of the third reset module 18 may be electrically connected to the third reference voltage signal terminal Vref3; and the control terminal of the third reset module 18 may be electrically connected to the third reference voltage signal terminal Vref3. The second terminal of the third reset module 18 may be electrically connected to the second node N2. For example, in the initialization stage t1, the third reset module 18 may be turned on under the control of the third scan signal output by the third scan signal line S3; and the third reference voltage signal output by the third reference voltage signal terminal Vref3 may reset the second node N2. By resetting the second node N2, the second node N2 may be pulled down to a lower potential, thereby ensuring that the second node N2 may be successfully written when the expected voltage value is subsequently written to the second node N2.

The third reference voltage signal terminal Vref3 may be multiplexed with the first reference voltage signal terminal Vref1 or the second reference voltage signal terminal Vref2. For example, the first terminal of the third reset module 18 may be connected to the first reference voltage signal terminal Vref1 or the second reference voltage signal terminal Vref2; and may use the reference voltage signal output from the first reference voltage signal terminal Vref1 or the second reference voltage signal terminal Vref2 to reset the second node N2.

Figure 14:
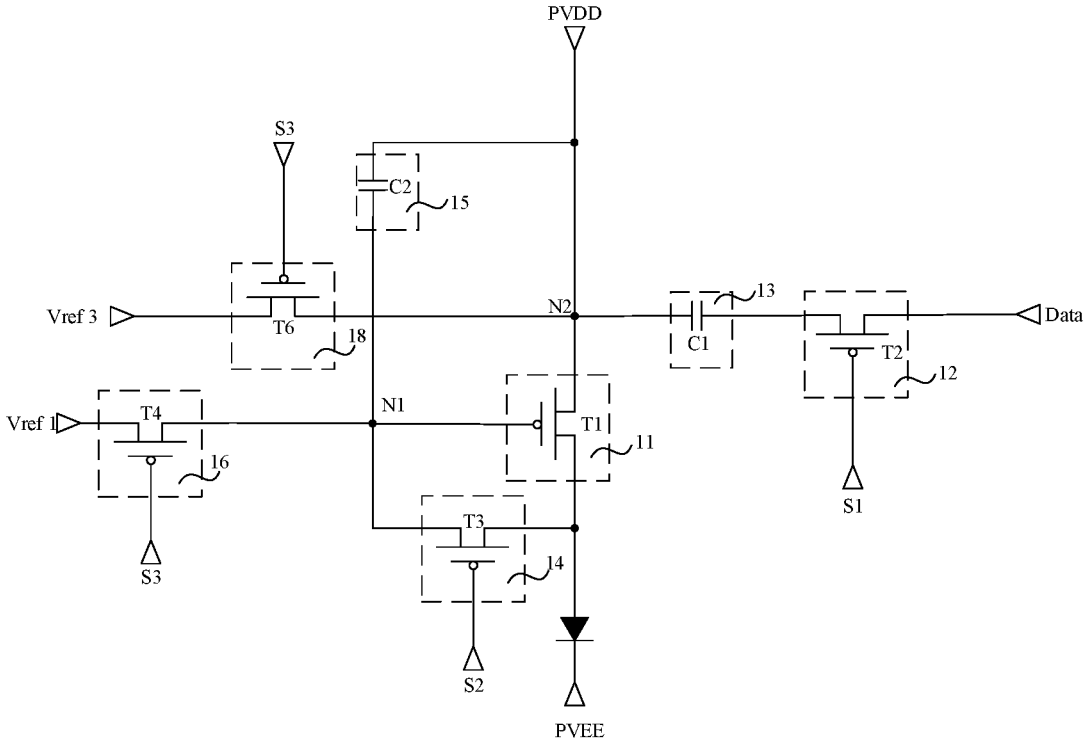
FIG. 14 illustrates another exemplary pixel driving circuit according to various disclosed embodiments of the present disclosure.

FIG. 14 is a schematic circuit diagram of another exemplary pixel driving circuit provided according to various disclosed embodiments of the present disclosure. As shown in FIG. 14, the third reset module 18 may include a sixth transistor T6. The control terminal of the sixth transistor T6 may be electrically connected to the third scan signal line S3; the first terminal of the sixth transistor T6 may be electrically connected to the third reference voltage signal terminal Vref3; and the second terminal of the sixth transistor T6 may be electrically connected to the second node N2. For example, in the initialization stage t1, the sixth transistor T6 may be turned on under the control of the third scan signal output by the third scan signal line S3; and the third reference voltage signal output by the third reference voltage signal terminal Vref3 reset the second node N2. By resetting the second node N2, the second node N2 may be pulled down to a lower potential, thereby ensuring that the second node N2 may be successfully written when the expected voltage value is subsequently written to the second node N2.

Figure 15:
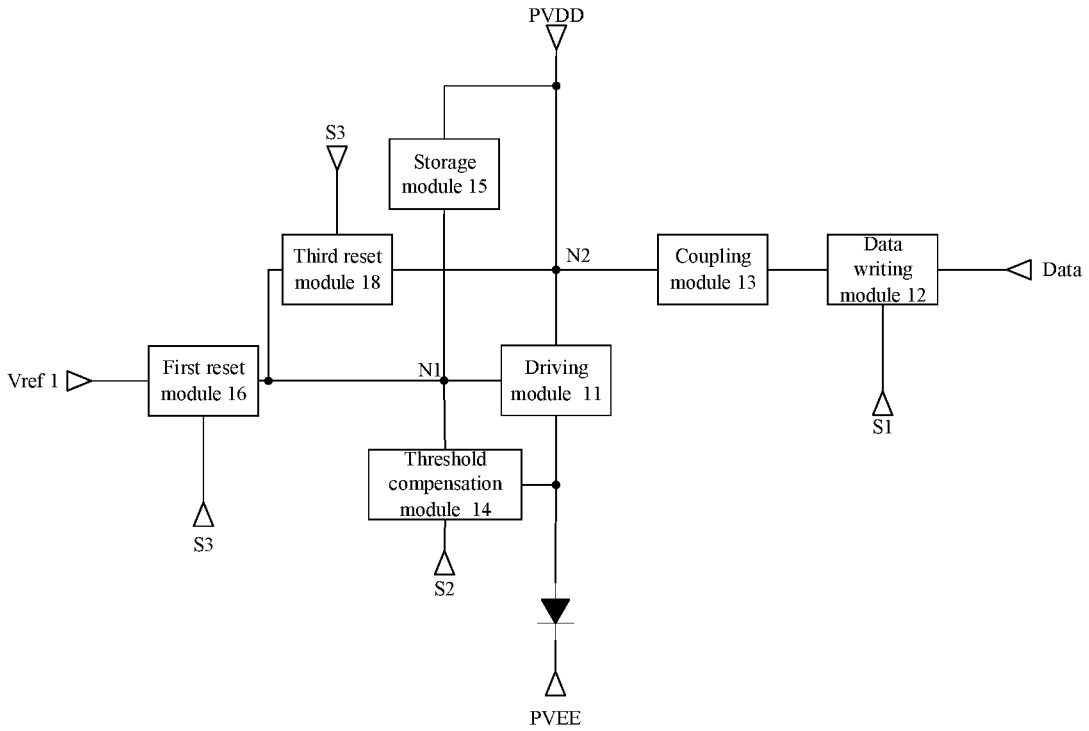
FIG. 15 illustrates another exemplary pixel driving circuit according to various disclosed embodiments of the present disclosure.

FIG. 15 is a schematic circuit diagram of another exemplary pixel driving circuit according to various disclosed embodiments of the present disclosure. The difference from FIG. 13 may include that the first terminal of the third reset module 18 shown in FIG. 15 may be electrically connected to the second terminal of the first reset module 16; and the first reference voltage signal output by the first reference voltage signal terminal Vref1 may reset the second node N2 sequentially through the first reset module 16 and the third reset module 18. As shown in FIG. 15, the control terminal of the third reset module 18 may be electrically connected with the third scan signal line S3; the first terminal of the third reset module 18 may be electrically connected with the second terminal of the first reset module 16; and the second terminal of the third reset module of 18 may be electrically connected to the second node N2 for resetting the second node N2. For example, in the initialization stage t1, the first reset module 16 may be turned on under the control of the third scan signal output by the third scan signal line S3; the third reset module 18 may be turned on under the control of the third scan signal output by the third scan signal line S3; and the first reference voltage signal may reset the second node N2 sequentially through the first reset module 16 and the third reset module 18. By resetting the second node N2, the second node N2 may be pulled down to a lower potential, thereby ensuring that the second node N2 may be successfully written when the expected voltage value is subsequently written to the second node N2.

Figure 16:
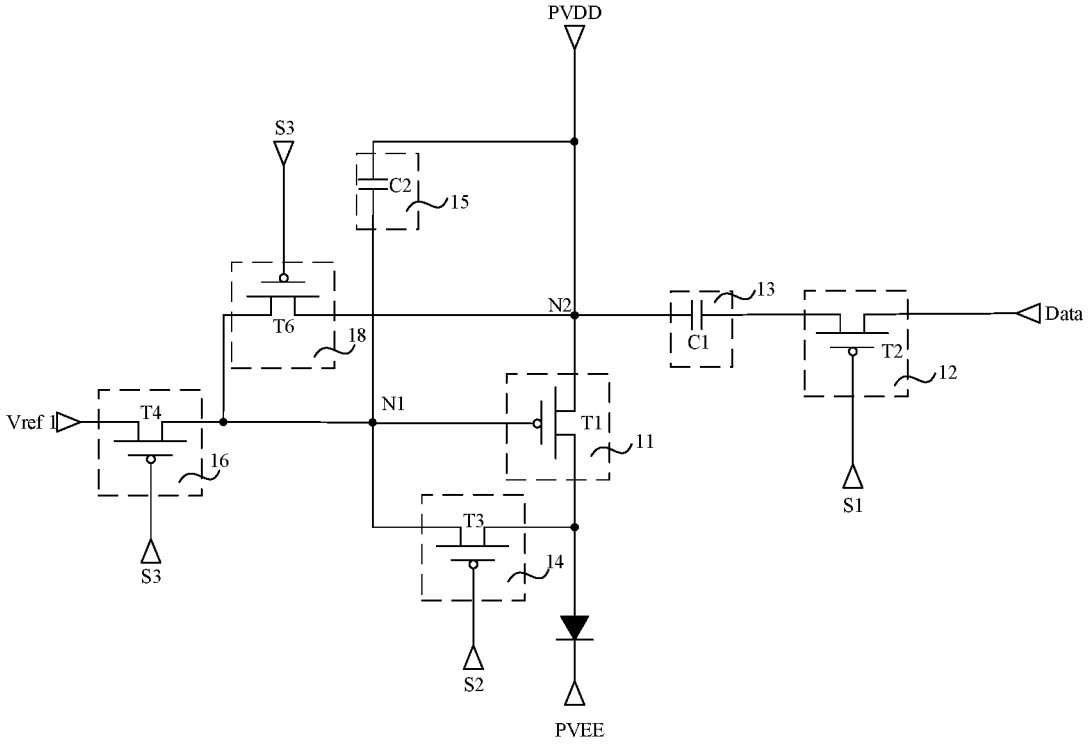
FIG. 16 illustrates another exemplary pixel driving circuit according to various disclosed embodiments of the present disclosure.

FIG. 16 is a schematic circuit diagram of another exemplary pixel driving circuit according to various disclosed embodiments of the present disclosure. As shown in FIG. 16, corresponding to the third reset module 18 shown in FIG. 15, the third reset module 18 may include a sixth transistor T6. The control terminal of the sixth transistor T6 may be electrically connected to the third scan signal line S3; the first terminal of the sixth transistor of T6 may be electrically connected to the second terminal of the first reset module 16; and the second terminal of the sixth transistor T6 may be electrically connected to the second node N2. For example, the control terminal of the sixth transistor T6 may be electrically connected to the third scan signal line S3; the first terminal of the sixth transistor T6 may be electrically connected to the second terminal of the fourth transistor T4; and the second terminal of the sixth transistor T6 may be electrically connected to the second node N2. In the initialization stage t1, the fourth transistor T4 may be turned on under the control of the third scan signal output by the third scan signal line S3; the sixth transistor T6 may be turned on by the third scan signal output by the third scan signal line S3; and the first reference voltage signal may reset the second node N2 sequentially through the fourth transistor T4 and the sixth transistor T6. By resetting the second node N2, the second node N2 may be pulled down to a lower potential, thereby ensuring that the second node N2 may be successfully written when the expected voltage value is subsequently written to the second node N2.

Figure 17:
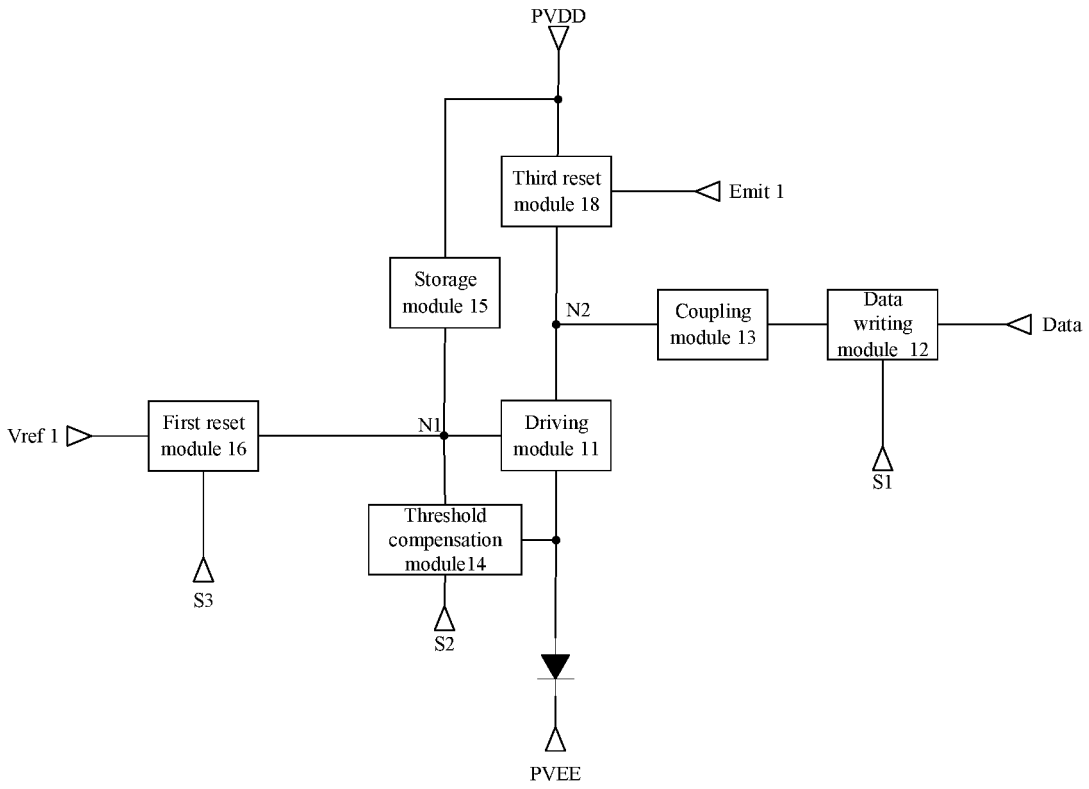
FIG. 17 illustrates another exemplary pixel driving circuit according to various disclosed embodiments of the present disclosure.

FIG. 17 is a schematic circuit diagram of another exemplary pixel driving circuit according to various disclosed embodiments of the present disclosure. As shown in FIG. 17, the difference from FIG. 13 may include that the control terminal of the third reset module 18 may be electrically connected to the first light-emitting control signal line Emit1; the first terminal of the third reset module 18 may be electrically connected to the first power supply voltage signal terminal PVDD; and the second terminal of the third reset module 18 may be electrically connected to the second node N2 and may be configured to reset the second node N2 by using the first power supply voltage signal input from the first power supply voltage signal terminal PVDD. In the initialization stage t1, the third reset module 18 may be turned on under the control of the first light-emission control signal output by the first light-emission control signal line Emit1; and the first power supply voltage signal may reset the second node N2. By resetting the second node N2, the second node N2 may be pulled down to a lower potential, thereby ensuring that the second node N2 may be successfully written when the expected voltage value is subsequently written to the second node N2.

Figure 18:
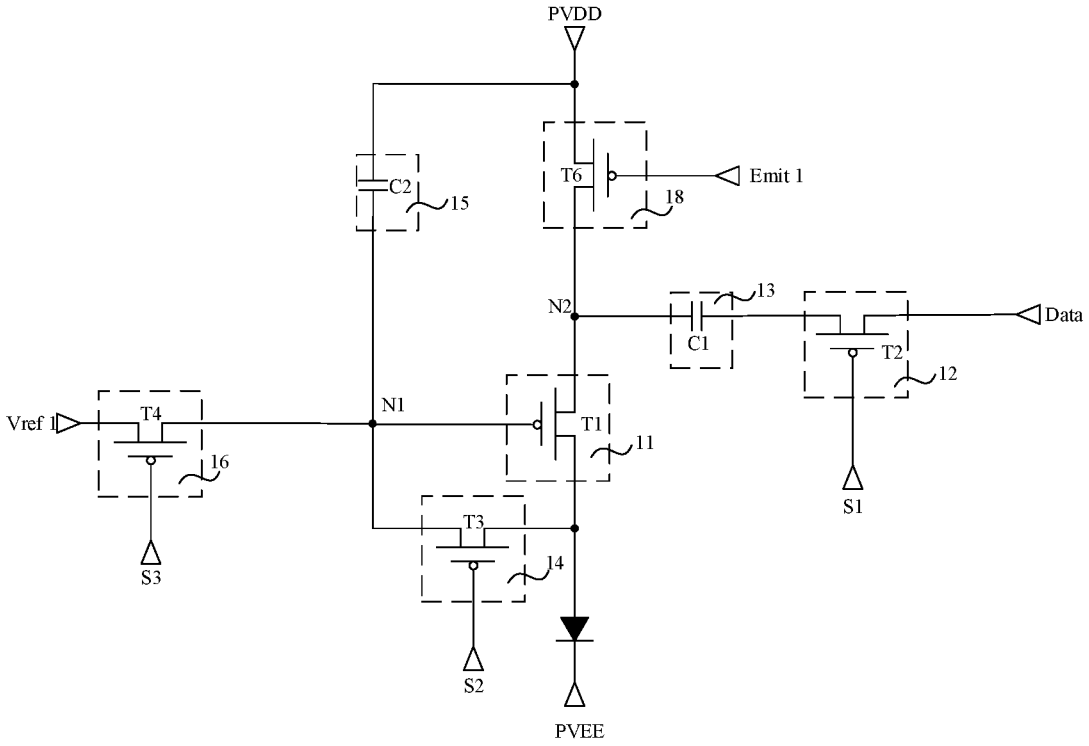
FIG. 18 illustrates another exemplary pixel driving circuit according to various disclosed embodiments of the present disclosure.

FIG. 18 is a schematic circuit diagram of another exemplary pixel driving circuit according to various disclosed embodiments of the present disclosure. As shown in FIG. 18, corresponding to the circuit shown in FIG. 17, the third reset module 18 may include a sixth transistor T6. The control terminal of the sixth transistor T6 may be electrically connected to the first light-emitting control signal line Emit1; the first terminal of the sixth transistor T6 may be electrically connected to the first light-emitting control signal line Emit1; the first terminal of the sixth transistor may be electrically connected to the first power supply voltage signal terminal PVDD; and the second terminal of the sixth transistor T6 may be electrically connected to the second node N2. The sixth transistor T6 may reset the second node N2 by using the first power supply voltage signal input from the first power supply voltage signal terminal PVDD. For example, in the initialization stage t1, the sixth transistor T6 may be turned on under the control of the first light-emission control signal output by the first light-emission control signal line Emit1; and the first power supply voltage signal may reset the second node N2. By resetting the second node N2, the second node N2 may be pulled down to a lower potential, thereby ensuring that the second node N2 may be successfully written when the expected voltage value is subsequently written to the second node N2.

Figure 19:
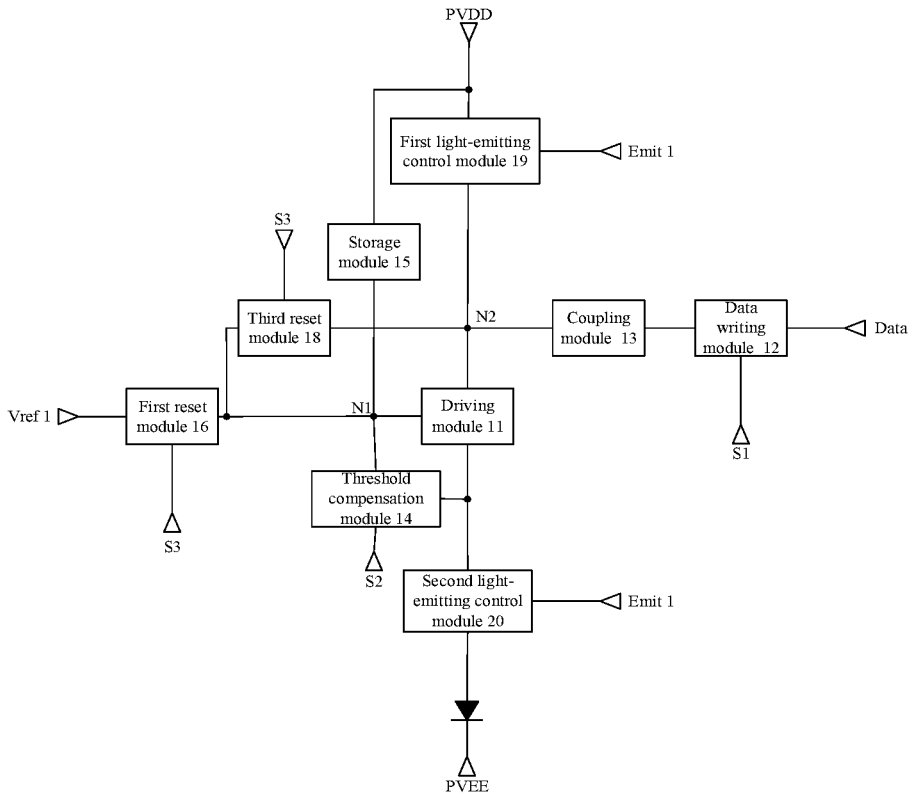
FIG. 19 illustrates another exemplary pixel driving circuit according to various disclosed embodiments of the present disclosure.

FIG. 19 is a schematic circuit diagram of another exemplary pixel driving circuit according to various disclosed embodiments of the present disclosure. As shown in FIG. 19, to ensure that the drive module 11 may not be affected by the first power supply voltage signal when the data signal is written, and to prevent the current of the drive module 11 from flowing into the light-emitting element when the data signal is written, based on the circuit in FIG. 13 or FIG. 15, the pixel driving circuit may also include a first light-emitting control module 19 and a second light-emitting control module 20.

The control terminal of the first light-emitting control module 19 may be electrically connected to the first light-emitting control signal line Emit1; the first terminal of the first light-emitting control module 19 may be electrically connected to the first power voltage signal terminal PVDD; and the first light emission control module 19 may be electrically connected to the first power supply voltage signal terminal PVDD. The second terminal of the first light-emitting control module 19 may be electrically connected to the second node N2. The control terminal of the second light-emitting control module 20 may be electrically connected to the first light-emitting control signal line Emit1; the first terminal of the second light-emitting control module 20 may be electrically connected to the second terminal of the driving module 11: and the second terminal of the second light-emitting control module 20 may be electrically connected to the second terminal of the driving module 11. The second terminal of the second light-emitting control module 20 may be electrically connected to the first terminal of the light-emitting element D1. In the lighting stage t3, the first light-emitting control module 19 may be turned on under the control of the first light-emitting control signal output by the first light-emitting control signal line Emit1; the second light-emitting control module 20 may be turned on under the control by the first light-emitting control signal output by the first lighting control signal line Emit1. The driving module 11 may be turned on under the control of the first node N1; and the driving module 11 may provide a driving current to the light-emitting element D1. The light-emitting element D1 may emit light under the driving of the driving current.

Figure 20:
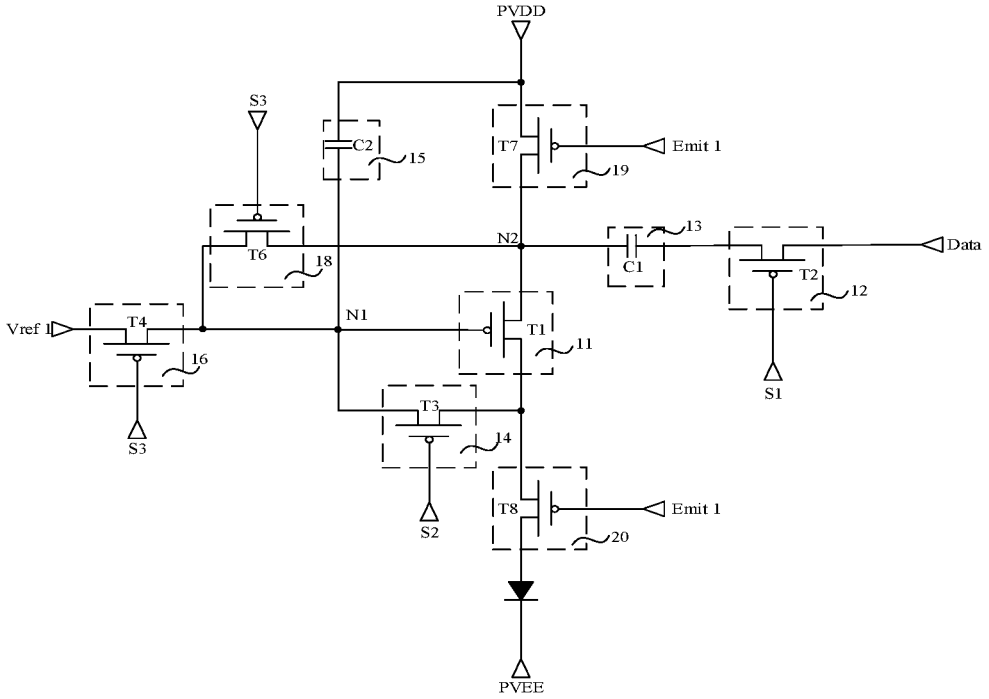
FIG. 20 illustrates another exemplary pixel driving circuit according to various disclosed embodiments of the present disclosure.

FIG. 20 is a schematic circuit diagram of another exemplary pixel driving circuit according to various disclosed embodiments of the present disclosure. As shown in FIG. 20, corresponding to the circuit shown in FIG. 19, the first light-emitting control module 19 may include a seventh transistor T7; and the second light-emitting control module 20 may include an eighth transistor T8. The control terminal of the seventh transistor T7 may be electrically connected to the first light-emitting control signal line Emit1; the first terminal of the seventh transistor T7 may be electrically connected to the first power supply voltage signal terminal PVDD; and the second terminal of the seventh transistor T7 may be electrically connected to the second node N2. The control terminal of the eighth transistor T8 may be electrically connected to the first light-emitting control signal line Emit1, and the first terminal of the eighth transistor T8 may be electrically connected to the second terminal of the driving module 11. For example, the first terminal of the eighth transistor T8 may be electrically connected to the second terminal of the first transistor T1; and the second terminal of the eighth transistor T8 may be electrically connected to the first terminal of the light-emitting element D1. In the light-emitting stage t3, the seventh transistor T7 may be turned on under the control of the first light-emitting control signal output by the first light-emitting control signal line Emit1; the eighth transistor T8 may be tuner on under the control of the first light-emitting control signal emitted by the first light-emitting control signal line Emit1. The first transistor T1 may be turned on under the control of the first node N1; the first transistor T1 may provide a driving current to the light-emitting element D1; and the light-emitting element D1 may emit light under the driving of the driving current.

Figure 21:
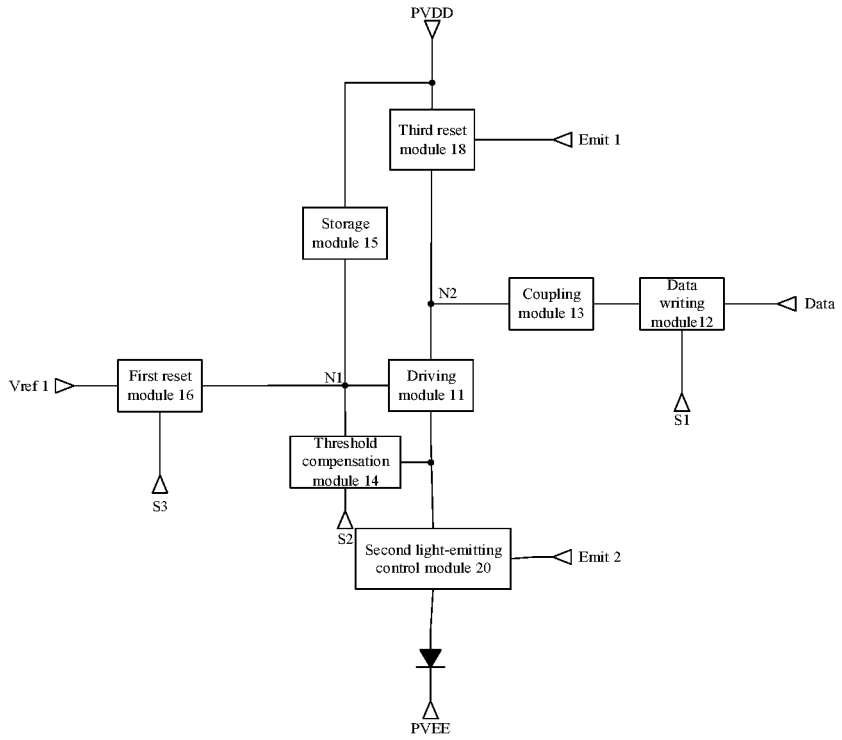
FIG. 21 illustrates another exemplary pixel driving circuit according to various disclosed embodiments of the present disclosure.

FIG. 21 is a schematic circuit diagram of another exemplary pixel driving circuit according to various disclosed embodiments of the present disclosure. As shown in FIG. 21, the difference from FIG. 19 may include that the third reset module 18 and the first light-emitting control module 19 shown in FIG. 21 may be multiplexed each other; and the third reset module 18 and the second light-emitting control module 20 may be respectively controlled by the first light-emitting control signal lines Emit1 and the second light-emitting control signal line Emit2. As shown in FIG. 21, based on the circuit shown in FIG. 17, the pixel driving circuit may further include a second light-emitting control module 20. The control terminal of the second light-emitting control module 20 may be electrically connected to the second light-emitting control signal line Emit2; the first terminal of the second light-emitting control module 20 may be electrically connected to the second terminal of the driving module 11; and the second terminal of the second light-emitting control module 20 may be electrically connected to the first terminal of the light-emitting element D1. In the light-emitting stage t3, the third reset module 18 may be turned on under the control of the first light-emitting control signal output by the first light-emitting control signal line Emit1; the second light-emitting control module 20 may be turned on under the control of the second light-emitting control signal output by the second light-emitting control signal line Emit2; the driving module 11 may be turned on under the control of the first node N1; and the driving module 11 may provide a driving current to the light-emitting element D1. The light-emitting element D1 may emit light under the driving of the driving current.

Figure 22:
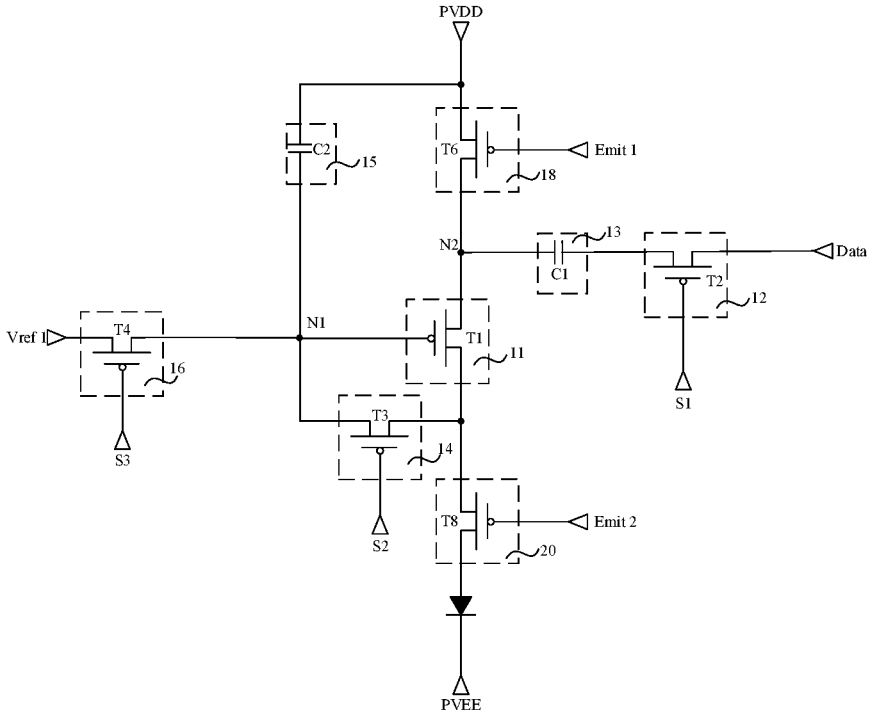
FIG. 22 illustrates another exemplary pixel driving circuit according to various disclosed embodiments of the present disclosure.

FIG. 22 is a schematic circuit diagram of another exemplary pixel driving circuit according to various disclosed embodiments of the present disclosure. As shown in FIG. 22, corresponding to the circuit shown in FIG. 21, the second light-emitting control module 20 may include an eighth transistor T8. The control terminal of the eighth transistor T8 may be electrically connected to the second light-emitting control signal line Emit2. The first terminal of the eighth transistor T8 may be electrically connected to the second terminal of the driving module 11. For example, the first terminal of the eighth transistor T8 may be electrically connected to the second terminal of the first transistor T1; and the second terminal of the eighth transistor T8 may be electrically connected to the first terminal of the light-emitting element D1. In the light-emitting stage t3, the sixth transistor T6 may be turned on under the control of the first light-emitting control signal output by the first light-emission control signal line Emit1; the eighth transistor T8 may be turned on under the control of the second light-emitting control signal output by the second light-emitting control signal line Emit2; and the first transistor T1 may be turned on under the control of the first node N1. The first transistor T1 may provide a driving current to the light-emitting element D1, and the light-emitting element D1 may emit light under the driving of the driving current.

Figure 23:
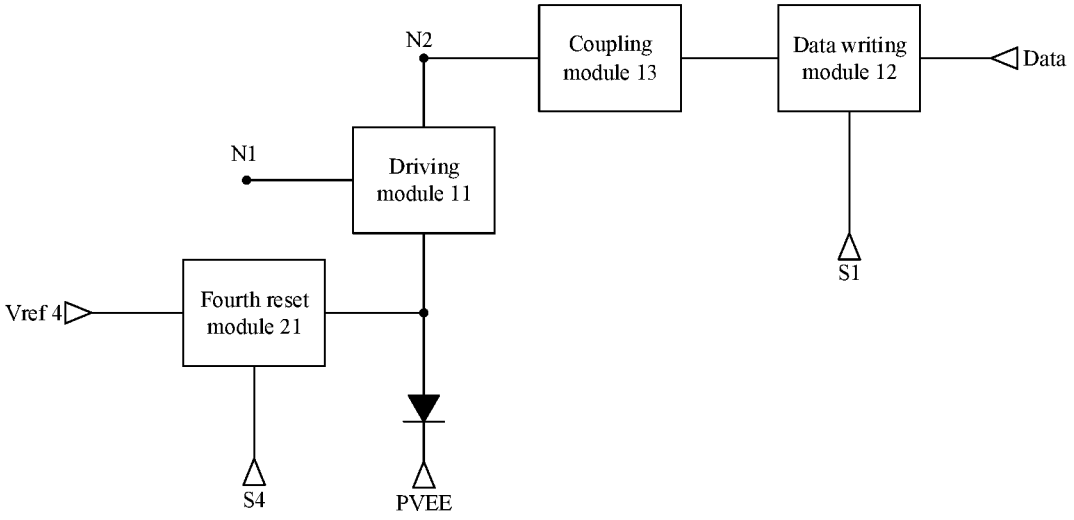
FIG. 23 illustrates another exemplary pixel driving circuit according to various disclosed embodiments of the present disclosure.

FIG. 23 is a schematic circuit diagram of another exemplary pixel driving circuit according to various disclosed embodiments of the present disclosure. As shown in FIG. 23, the pixel driving circuit may further include a fourth reset module 21. The fourth reset module 21 may be configured to reset the first terminal of the light-emitting element D1.

The control terminal of the fourth reset module 21 may be electrically connected to the fourth scan signal line S4; the first terminal of the fourth reset module 21 may be electrically connected to the fourth reference voltage terminal Vref4; and the second terminal of the fourth reset module 21 may be electrically connected to the first terminal of the light-emitting element D1. In the initialization stage t1, the fourth reset module 21 may be turned on under the control of the fourth scan signal output by the fourth scan signal line S4; and the fourth reference voltage signal output by the fourth reference voltage signal terminal Vref4 may reset the light-emitting element D1. The first terminal of the light-emitting element D1 may be the anode of the light-emitting element D1.

The fourth scan signal line S4 may be multiplexed with the third scan signal line S3, and the fourth reference voltage signal terminal Vref4 may be multiplexed with any one of the previously described first reference voltage signal terminal Vref1, the second reference voltage signal terminal Vref2, and the third reference voltage signal terminals Vref3. In other words, each of the first reference voltage signal terminal Vref1, the second reference voltage signal terminal Vref2, the third reference voltage signal terminal Vref3, and the fourth reference voltage signal terminal Vref4 may be multiplexed with each other. Further, the first terminal of the fourth reset module 21 may also be connected to the second terminal of the first reset module 16; and the first reference voltage signal output by the first reference voltage signal terminal Vref1 may sequentially pass through the first reset module 16 and the fourth reset module 21 to reset the first terminal of the light-emitting element D1. In another embodiment, the first terminal of the fourth reset module 21 may also be connected to the second terminal of the threshold compensation module 14. The first reference voltage signal may sequentially pass through the first reset module 16, the threshold compensation module 14, and the fourth reset module 21 to reset the first terminal of the light-emitting element D1.

Figure 24:
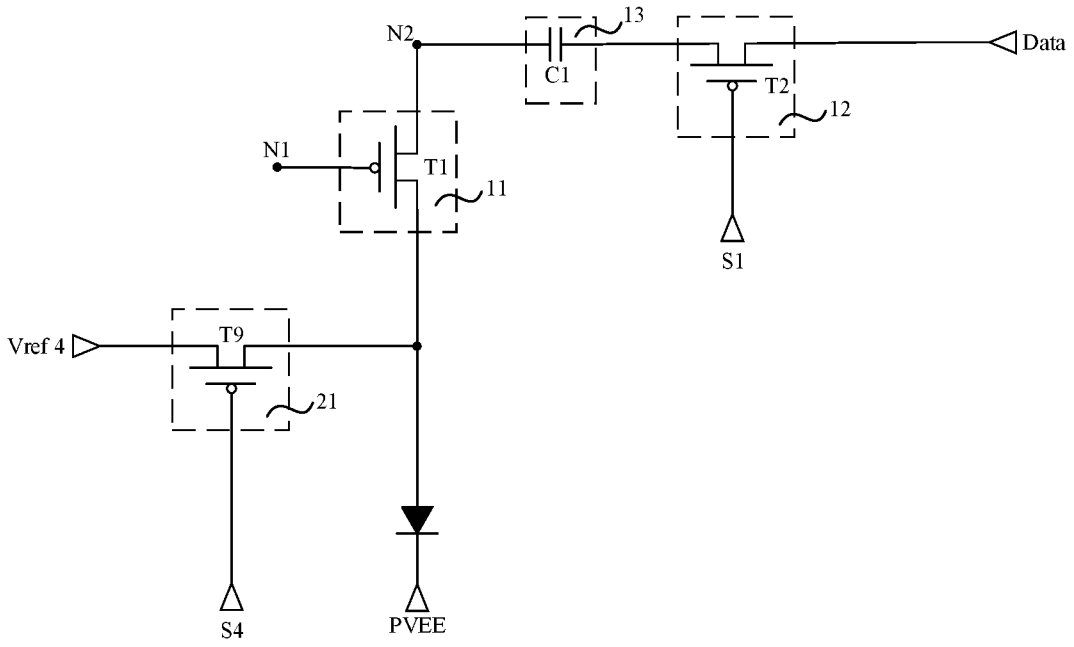
FIG. 24 illustrates another exemplary pixel driving circuit according to various disclosed embodiments of the present disclosure.

FIG. 24 is a schematic circuit diagram of another exemplary pixel driving circuit according to various disclosed embodiments of the present disclosure. As shown in FIG. 24, corresponding to the circuit shown in FIG. 23, the fourth reset module 21 may include a ninth transistor T9. The control terminal of the ninth transistor T9 may be electrically connected to the fourth scan signal line S4. The first terminal of the ninth transistor T9 may be electrically connected to the fourth reference voltage signal terminal Vref4; and the second terminal of the ninth transistor T9 may be electrically connected to the first terminal of the light-emitting element D1 for resetting the first terminal of the light-emitting element D1. In the initialization stage t1, the ninth transistor T9 may be turned on under the control of the fourth scan signal output by the fourth scan signal line S4; and the fourth reference voltage signal output by the fourth reference voltage signal terminal Vref4 may reset the first terminal of the light-emitting element D1.

The pixel driving circuit will be described in detail below in conjunction with two specific examples of the pixel driving circuit shown in FIG. 25 and FIG. 26.

Figure 25:
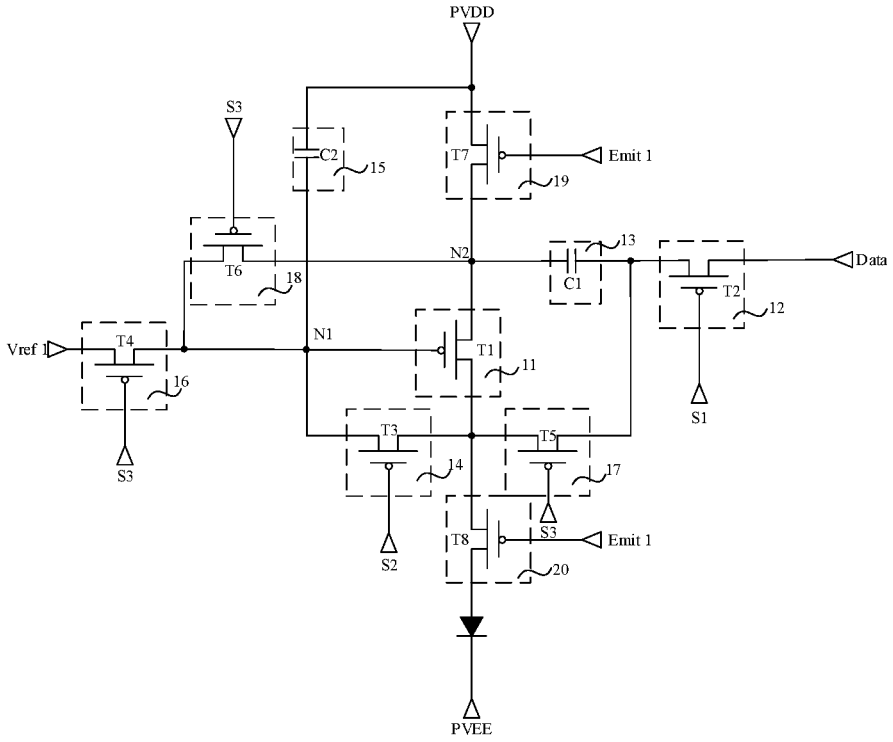
FIG. 25 illustrates another exemplary pixel driving circuit according to various disclosed embodiments of the present disclosure.
Figure 26:
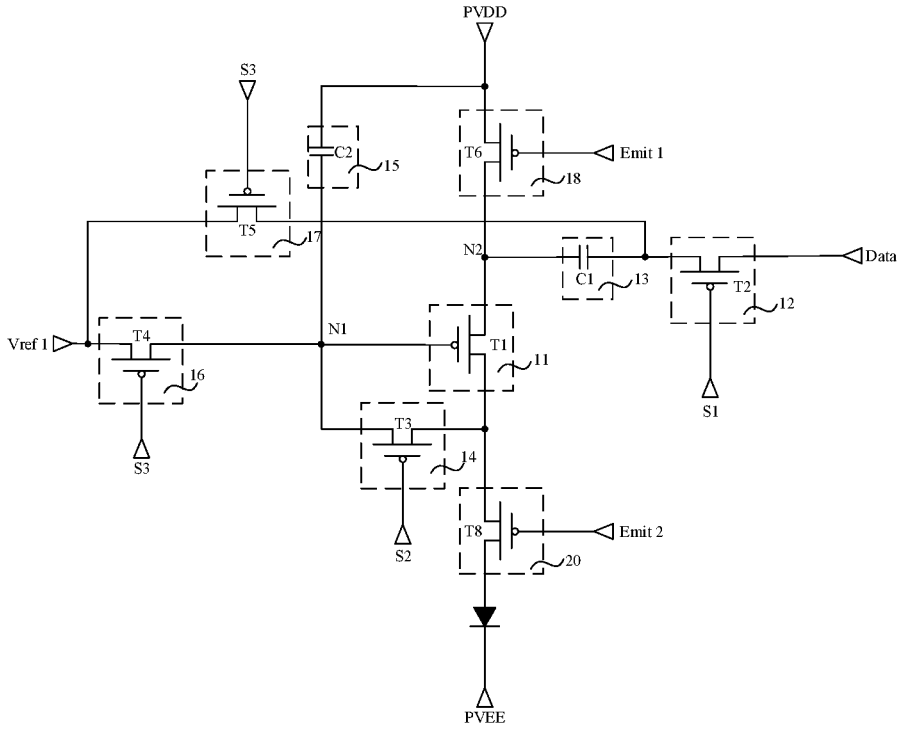
FIG. 26 illustrates another exemplary pixel driving circuit according to various disclosed embodiments of the present disclosure.

Before describing the pixel driving circuits shown in FIGS. 25-26 in detail, it should be noted that in the pixel driving circuits shown in FIGS. 25-26, each transistor is described by taking a P-type transistor as an example. For P-type transistors, the turn-on level is a low level, and the turn-off level is a high level. For example, when the control terminal of the P-type transistor is the low level, the first terminal and the second terminal may be turned on for a conduction, and when the control terminal of the P-type transistor is the high level, the first terminal and the second terminal are turned off for a disconnection. In specific implementation, one or more transistors in the pixel driving circuit shown in FIG. 25 and FIG. 26 may also be replaced with N-type transistors. For N-type transistors, the turn-on level is a high level, and the turn-off level is a low level. For example, when the control terminal of the N-type transistor is at the high level, the first terminal and the second terminal may be turned on for a conduction, and when the control terminal of the N-type transistor is at the low level, the first terminal and the second terminal may be turned off for a disconnection. For example, taking the second transistor T2 shown in FIG. 25 as an example, when the P-type second transistor T2 is replaced by with an N-type transistor, only the time sequence of the first scan signal line S1 that controls the second transistor T2 needs to be changed from "high level-low level-high level" in stages t1-t3 to "low level-high level-low level", and other transistors may be similar, and will not be repeated here.

Figure 27:
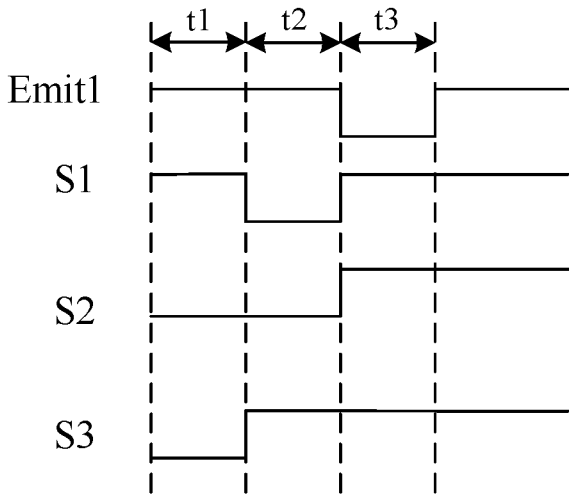
FIG. 27 illustrates an exemplary sequence diagram of the pixel driving circuit in FIG. 25.

FIG. 27 is an exemplary sequence diagram of the pixel driving circuit shown in FIG. 25. As shown in FIG. 25 and FIG. 27, the sequence diagram may include three stages.

In the initialization stage t1, the second scan signal line S2 may output a turn-on level, and the third scan signal line S3 may output a turn-on level. The fourth transistor T4 may be turned on under the control of the third scan signal line S3, and the first reference voltage signal may reset the first node N1. The sixth transistor T6 may be turned on under the control of the third scan signal line S3, and the first reference voltage signal may reset the second node N2. The third transistor T3 may be turned on under the control of the second scan signal line S2. The fifth transistor T5 may be turned on under the control of the third scan signal line S3. The first reference voltage signal may sequentially pass through the fourth transistor T4, the third transistor T3 and the fifth transistor T5 to reset the first plate of the coupling capacitor C1.

In the data writing stage t2, the first scan signal line S1 may output a turn-on level; the second scan signal line S2 may output a turn-on level; and the third scan signal line S3 may output a turn-off level. The third transistor T3 may be turned on under the control of the second scan signal line S2. The third transistor T3 may turn on the control terminal of the first transistor T1 and the second terminal of the first transistor T1. The first transistor T1 may be turned on under the control of the first node N1. The first transistor T1, the third transistor T3 and the storage capacitor C2 may form a loop. The second transistor T2 may be turned on under the control of the first scan signal line S1; and the data signal may be coupled to the first terminal of the first transistor T1 through the coupling capacitor C1. The first transistor T1 may capture the threshold; the potential of the control terminal of the first transistor T1 may be adjusted to VN1=VN2−Vth; and the compensation for the threshold voltage Vth of the first transistor T1 may be realized.

In the light-emitting stage t3, the first light-emission control signal line Emit1 may output a turn-on level. The seventh transistor T7 may be turned on under the control of the first light-emitting control signal line Emit1; the eighth transistor T8 may be turned on under the control of the first light-emission control signal line Emit1; and the first transistor T1 may be turned on under the control of the first node N1. The first transistor T1 may provide a driving current to the light-emitting element D1; and the light-emitting element D1 may emit light under the driving of the driving current. The driving current may be $I=1/2cox\ \mu W/L\ (V_{PVDD}-c2/(c1+c2)\times Vdata)^2$. cox represents the capacitance of the gate dielectric layer of the first transistor T1; μ represents the mobility of the first transistor T1; W/L represents the width-to-length ratio of the first transistor T1; $V_{PVDD}$ represents the voltage value of the first power supply voltage signal; Vdata represents the voltage value of the data signal; c1 represents the capacitance of the coupling capacitor C1; and c2 represents the capacitance of the storage capacitor C2.

Figure 28:
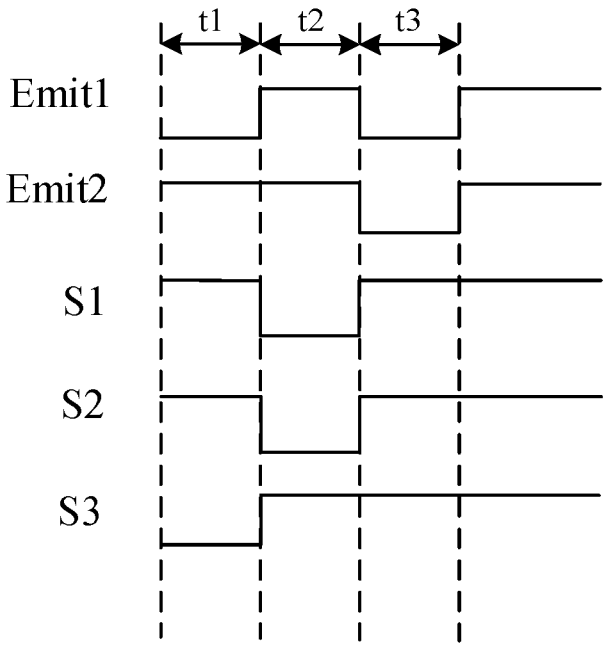
FIG. 28 illustrates another exemplary sequence diagram of the pixel driving circuit in FIG. 26.

FIG. 28 is an exemplary time sequence of the pixel driving circuit shown in FIG. 26. As shown in FIG. 26 and FIG. 28, the time sequence may include three stages.

In the initialization stage t1, the first light-emitting control signal line Emit1 outputs a turn-on level; and the third scanning signal line may output a turn-on level. The sixth transistor T6 may be turned on under the control of the first light-emitting control signal line Emit1; and the first power supply voltage signal output by the first power supply voltage signal terminal PVDD may reset the second node N2; and at this time, the potential of the second node N2 may be $V_{PVDD}$. The fourth transistor T4 may be turned on under the control of the third scan signal line S3; and the first reference voltage signal output from the first reference voltage signal terminal Vref1 may reset the first node N1. The fifth transistor T5 may be turned on under the control of the third scan signal line S3; and the first reference voltage signal may reset the first plate of the coupling capacitor C1. At this time, the potential at the first plate of the coupling capacitor C1 may be Vref; and Vref may represents the voltage value of the first reference voltage signal.

In the data writing stage t2, the first light-emitting control signal line Emit1 may output a turn-off level; the first scan signal line S1 may output a turn-on level; the second scan signal line S2 may output a turn-on level; and the third scan signal line S3 may output a turn-off level. The third transistor T3 may be turned on under the control of the second scan signal line S2; the third transistor T3 may turn on the control terminal of the first transistor T1 and the second terminal of the first transistor T1; the first transistor T1 may be turned on under the control of the first node N1; and the first transistor T1, the third transistor T3 and the storage capacitor C2 may form a loop. The second transistor T2 may be turned on under the control of the first scan signal line S1, and the data signal may be coupled to the first terminal of the first transistor T1 through the coupling capacitor C1. The first transistor T1 may capture the threshold; and the potential of the control terminal of the first transistor T1 may be adjusted to $V_{N1}=V_{N2}-Vth=V_{PVDD}+Vdata-Vref'-Vth$. Accordingly, the threshold voltage Vth of the first transistor T1 may be compensated.

When the control time sequence of the second transistor T2 and the third transistor T3 are the same, for example, when both the second transistor T2 and the third transistor T3 are turned on only during the data writing stage t2, the first scan signal line S1 that controls on/off of the second transistor T2 and the second scan signal line S2 that controls the on/off of the third transistor T3 may be multiplexed each other. For example, the first scan signal line S1 and the second scan signal line S2 may be a same scan signal line; and the control terminal of the second transistor T2 and the control terminal of the third transistor T3 may be connected to the same scanning signal line.

In the light-emitting stage t3, the first light-emitting control signal line Emit1 may output a turn-on level; and the second light-emission control signal line Emit2 may output a turn-on control signal line Emit1; the eighth transistor T8 may be turned on under the control of the second light-emitting control signal line Emit2, and the first transistor T1 may be turned on under the control of the first node N1. The first transistor T1 may provide a driving current to the light-emitting element D1; and the light-emitting element D1 may be driven to emit light by the driving current. The magnitude of the driving current may be $I=1/2cox\ \mu(Vref'-Vdata)^2$.

Figure 29:
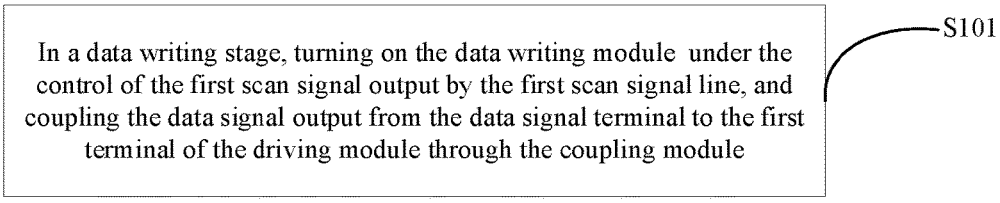
FIG. 29 illustrates a flow chart of an exemplary driving method according to various disclosed embodiments of the present disclosure.

The present disclosure also provides a driving method. FIG. 29 illustrates an exemplary driving method consistent with various disclosed embodiments of the present disclosure.

As shown in FIG. 29, the driving method provided by the embodiment of the present disclosure may include S101, in the data writing stage, the data writing module may be turned on under the control of the first scan signal output by the first scan signal line, and the data signal output by the data signal terminal may be coupled to the first terminal of the driving module through the coupling module.

In the driving method of the embodiment of the present disclosure, the data signal written by the data writing module 12 may be coupled to the first terminal of the driving module 11 through the coupling module 13 in the data writing stage, and the coupling module 13 may perform a voltage division during the light-emitting stage, the effect to the potential of the control terminal of the driving module 11 caused by the data signal input by the leakage current may be reduced. Accordingly, the potential of the control terminal of the driving module 11 may be maintained within the preset threshold range; and the normal light-emitting of the light-emitting element may be ensured. Thus, the technical problems of inconsistency between the brightness and expected normal brightness of the light-emitting element and the poor display may be solved.

Figure 30:
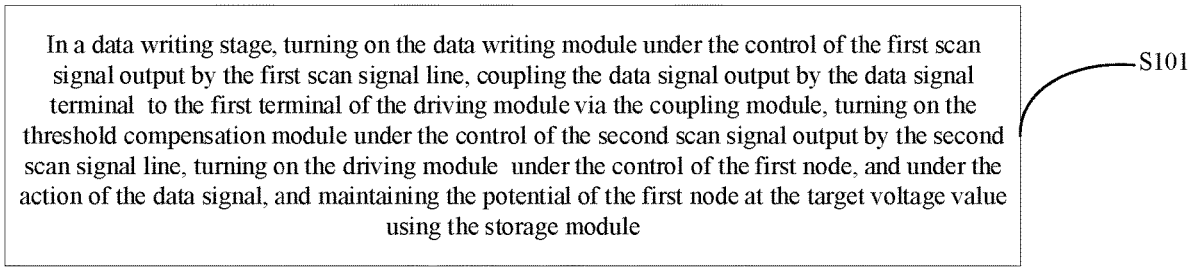
FIG. 30 illustrates a flow chart of another exemplary driving method according to various disclosed embodiments of the present disclosure.

As shown in FIG. 30, in some embodiments, S101 may further include that, in the data writing stage, the threshold compensation module may be turned on under the control of the second scan signal output by the second scan signal line; and the driving module may be turned on under the control of the first node. Under the action of the data signal, the storage module may maintain the potential of the first node at the target voltage value. As an example, the target voltage value may be the difference between the voltage value of the first terminal of the driving module and the threshold voltage of the driving module.

Figure 31:
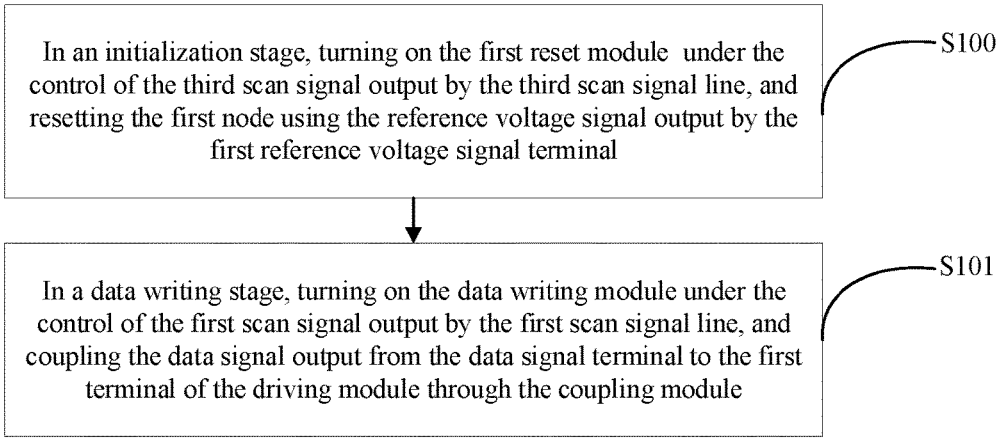
FIG. 31 illustrates a flow chart of another exemplary driving method according to various disclosed embodiments of the present disclosure.

Further, as shown in FIG. 31, in some embodiments, before S101, the driving method provided in the embodiment of the present disclosure may further include S100, in the initialization stage, the first reset module may be turned on under the control of the third scan signal output by the third scan signal line; and the reference voltage signal output by the first reference voltage signal terminal may reset the first node.

Figure 32:
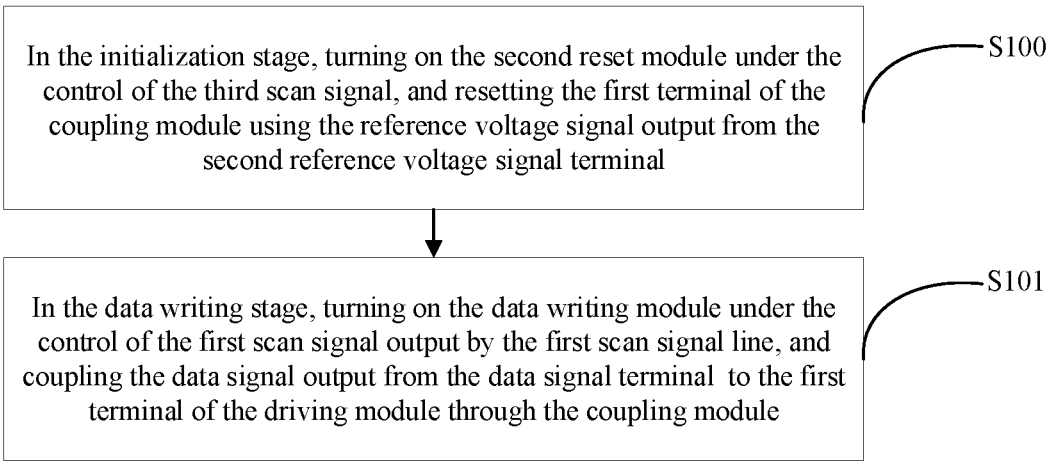
FIG. 32 illustrates a flow chart of another exemplary driving method according to various disclosed embodiments of the present disclosure.

Further, as shown in FIG. 32, in some embodiments, S100 may further include that, in an initialization stage, the second reset module may be turned on under the control of the third scan signal, and the reference voltage signal output by the second reference voltage signal terminal may reset the first terminal of the coupling module.

Figure 33:
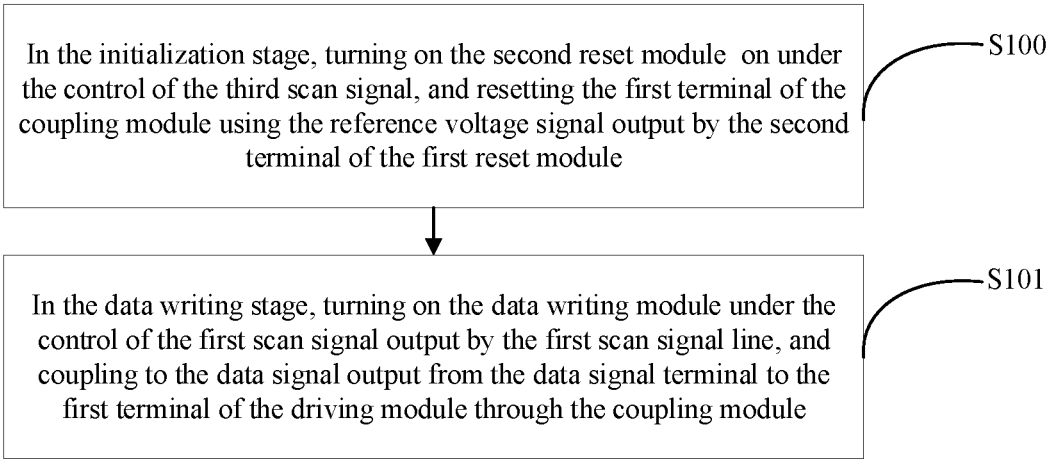
FIG. 33 illustrates a flow chart of another exemplary driving method according to various disclosed embodiments of the present disclosure.

Further, as shown in FIG. 33, in some embodiments, S100 may further include that, in an initialization stage, the second reset module may be turned on under the control of the third scan signal, and the reference voltage signal output by the second terminal of the first reset module may reset the first terminal of the coupling module.

Figure 34:
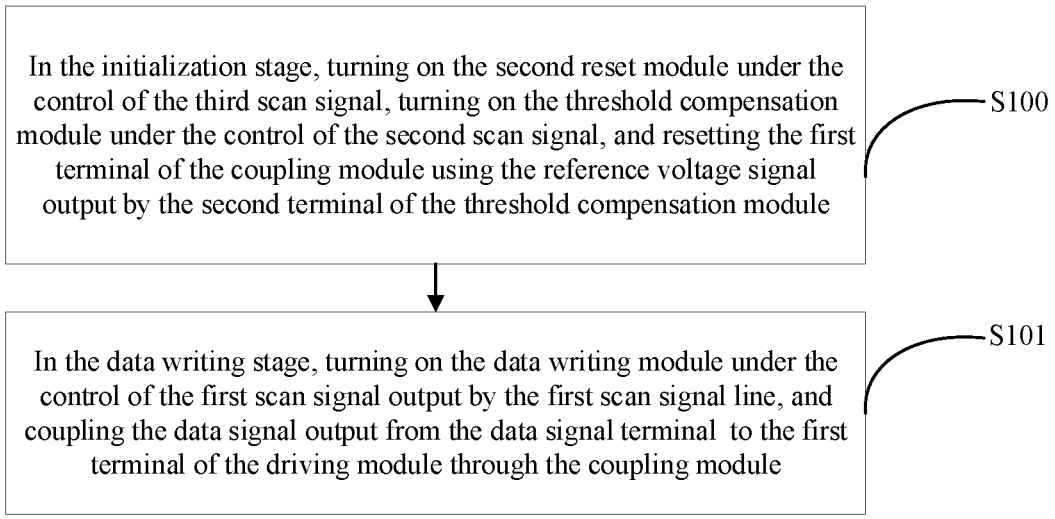
FIG. 34 illustrates a flow chart of another exemplary driving method according to various disclosed embodiments of the present disclosure.

Further, as shown in FIG. 34, in some embodiments, S100 may further include that, the initialization stage, the second reset module may be turned on under the control of the third scan signal; the threshold compensation module may be turned on under the control of the second scan signal; and the reference voltage signal output from the second terminal of threshold compensation module may reset the first terminal of the coupling module.

Figure 35:
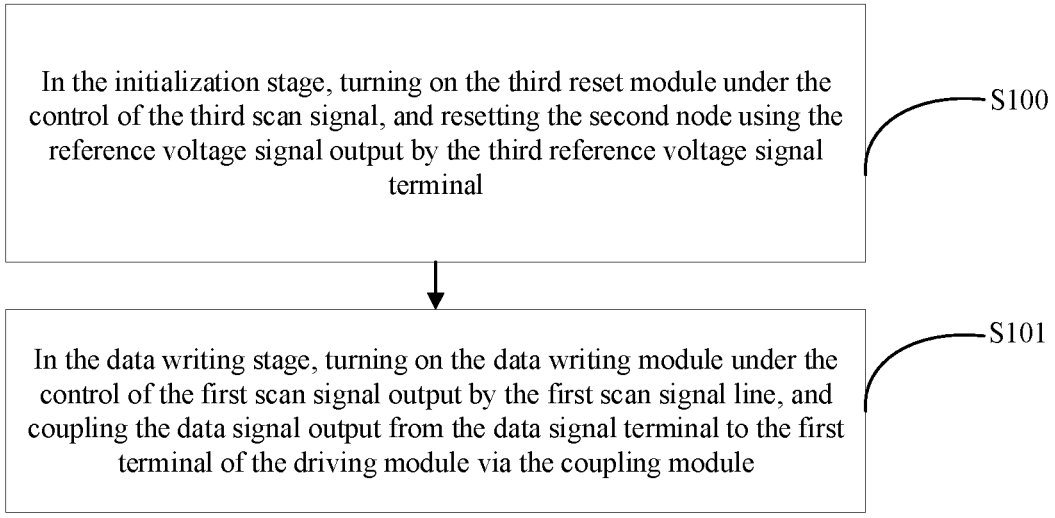
FIG. 35 illustrates a flow chart of another exemplary driving method according to various disclosed embodiments of the present disclosure.

Further, as shown in FIG. 35, in some embodiments, S100 may further include that, in an initialization stage, the third reset module may be turned on under the control of the third scan signal; and the reference voltage signal output by the third reference voltage signal terminal may reset the second node.

Figure 36:
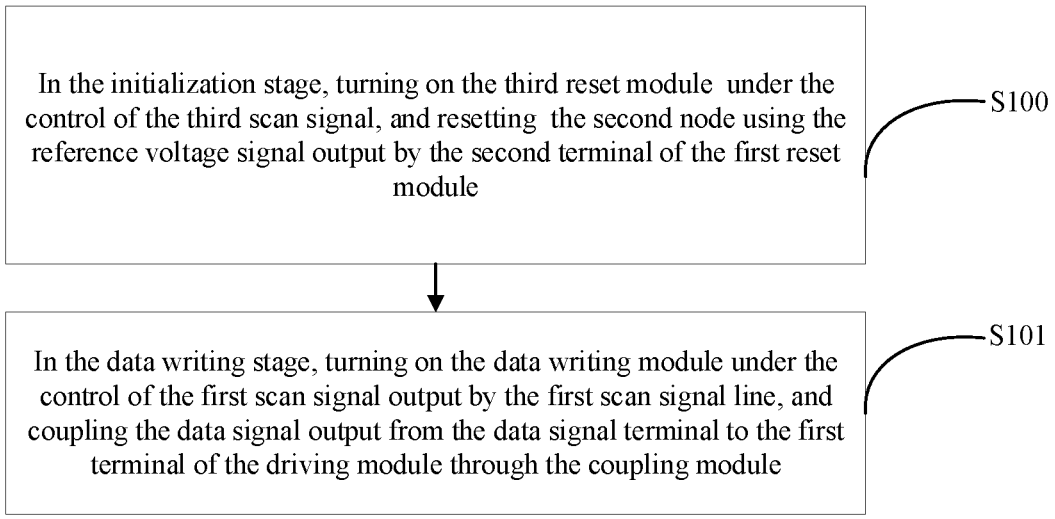
FIG. 36 illustrates a flow chart of another exemplary driving method according to various disclosed embodiments of the present disclosure.

Further, as shown in FIG. 36, in some embodiments, S100 may further include that, in the initialization stage, the third reset module may be turned on under the control of the third scan signal, and the reference voltage signal output by the second terminal of the first reset module may reset the first reset module.

Figure 37:
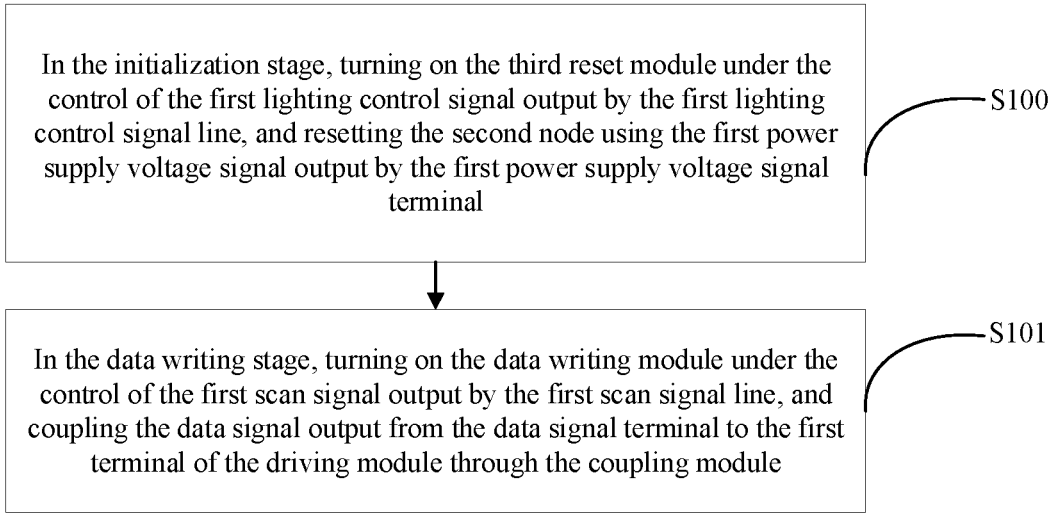
FIG. 37 illustrates a flow chart of another exemplary driving method according to various disclosed embodiments of the present disclosure.

Further, as shown in FIG. 37, in some embodiments, S100 may further include that, in an initialization stage, the third reset module may be turned on under the control of the first light-emitting control signal output by the first light-emitting control signal line, and the first power supply voltage signal output by the first power supply voltage signal terminal may reset the second node.

Figure 38:
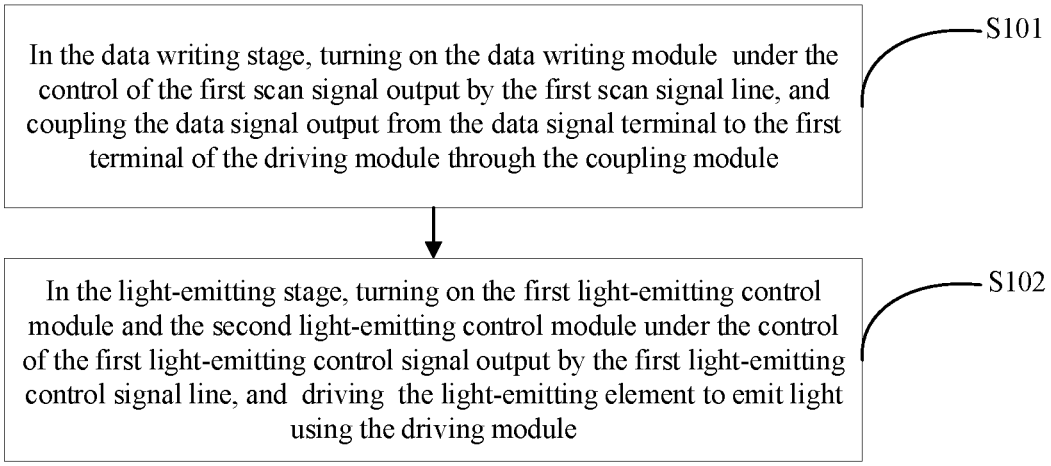
FIG. 38 illustrates a flow chart of another exemplary driving method according to various disclosed embodiments of the present disclosure.

Further, as shown in FIG. 38, in some embodiments, after S101, the driving method provided in the present disclosure may further include S102 that, in the light-emitting stage, the first light-emitting control module and the second light-emitting control module may be turned on under the control of the first light-emitting control signal output by the first light-emitting control signal line, and the driving module may drive the light-emitting element to emit light.

Figure 39:
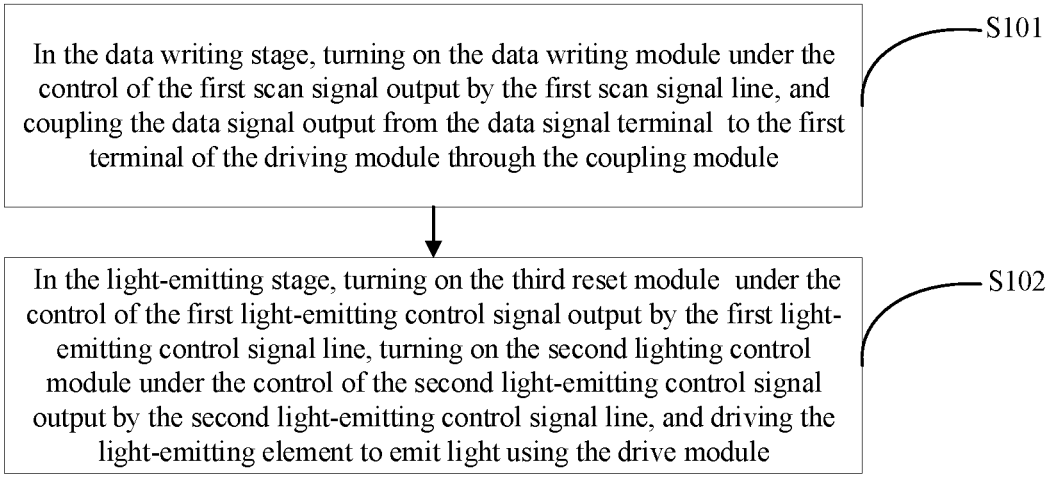
FIG. 39 illustrates a flow chart of another exemplary driving method according to various disclosed embodiments of the present disclosure.

Further, as shown in FIG. 39, in some embodiments, after S101, the driving method provided in the present disclosure may further include S102 that in the light-emitting stage, the third reset module may be turned on under the control of the first light-emitting control signal output by the first light-emitting control signal line; and the second light-emitting control module may be turned on under the control of the second light-emitting control signal output by the second lighting control signal line; and the driving module may drive the light-emitting element to emit light.

S100, S101, and S102 in the driving method provided in the embodiments of the present may be described in detail when introducing the pixel driving circuit of the embodiments of the present disclosure; and the details may be referred to the previous description.

Figure 40:
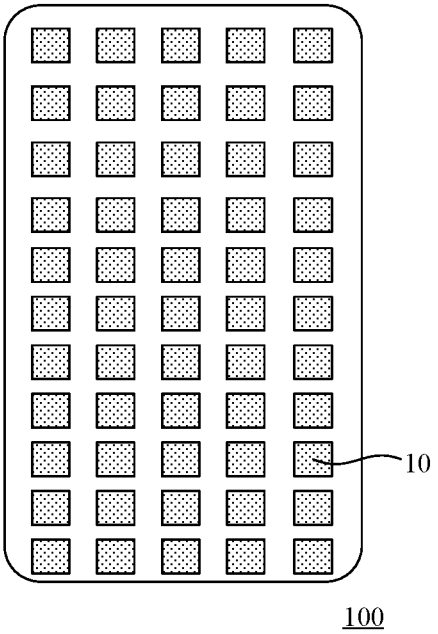
FIG. 40 illustrates an exemplary display panel according to various disclosed embodiments of the present disclosure.

The present disclosure also provides a display panel. FIG. 40 illustrates an exemplary display panel according to various disclosed embodiments of the present disclosure.

As shown in FIG. 40, the display panel 100 may include a pixel driving circuit 10. The pixel driving circuit 10 may be a present disclosed driving circuit, or other appropriate driving circuits. The display panel 10 may include an AM-OLED display panel, etc.

Figure 41:
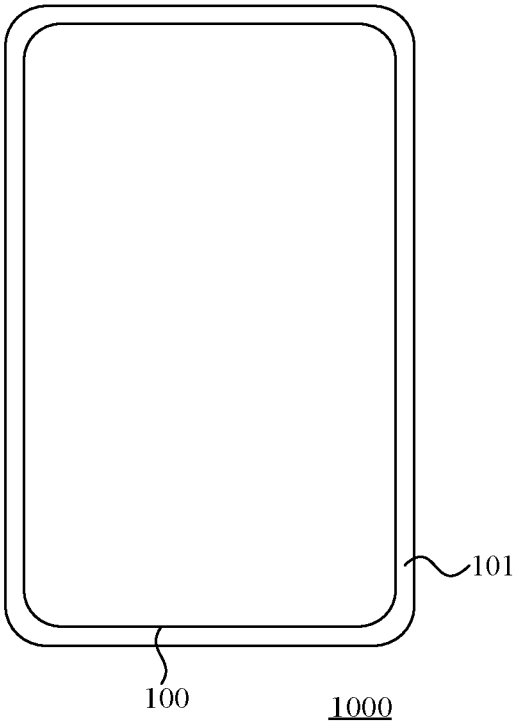
FIG. 41 illustrates an exemplary display device according to various disclosed embodiments of present disclosure.

Further, the present disclosure provides a display device. FIG. 41 illustrates an exemplary display device according to various disclosed embodiments of the present disclosure.

As shown in FIG. 41, the display device 1000 may include a device body 101 and a display panel 100, and the display panel 100 may cover the device body 101. The display panel 100 may be a present disclosed display panel, or other appropriate display panel. Various devices, such as sensor devices, processing devices, etc., may be disposed in the device body 101. The display device 1000 may include a device with a display function, such as a mobile phone, a computer, a tablet computer, a digital camera, a television, or an electronic paper, etc.

Thus, the pixel driving circuit, the driving method, the display panel, and the display device of the embodiments of the present disclosure provide a novel data signal writing method. The data writing module may be no longer connected to the control terminal of the driving module, but it may be connected to the first terminal of the driving module, and a coupling module may also be disposed between the data writing module and the driving module. In the data writing stage, the data signal written by the data writing module may be coupled to the first terminal of the driving module through the coupling module. In the light-emitting stage, the coupling module may perform a voltage division to reduce the impact of the data signal input due to the leakage current on the potential of the control terminal of the driving module. Thus, the potential of the control terminal of the driving module may be maintained within the preset threshold range, the normal light emission of the light-emitting element may be ensured, and the technical problems that the brightness of the light-emitting element is inconsistent with the expected normal brightness and the display quality is not as expected may be solved.

It should be clear that the various embodiments in this specification are described in a progressive manner, and the same or similar parts between the various embodiments can be referred to each other. Each embodiment focuses on the differences from other embodiments. Regarding the display panel embodiment and the display device embodiment, the relevant points may be referred to the description part of the pixel driving circuit embodiment and the array substrate embodiment. The disclosure is not limited to the specific structure described above and shown in the drawings. Those skilled in the art can make various changes, modifications, and additions after understanding the spirit of this disclosure. And, for the sake of brevity, a detailed description of the known technology is omitted here.

Those skilled in the art should understand that the above-mentioned embodiments are all illustrative and not restrictive. Different technical features appearing in different embodiments can be combined to achieve beneficial effects. Those skilled in the art should be able to understand and implement other modified embodiments of the disclosed embodiments on the basis of studying the drawings, the description, and the claims. In the claims, the term "comprising" does not exclude other structures; the number refers to "one" but does not exclude multiple; the terms "first" and "second" are used to denote names rather than to indicate any specific order. Any reference signs in the claims should not be construed as limiting the scope of protection. The appearance of certain technical features in different dependent claims does not mean that these technical features cannot be combined to achieve beneficial effects.

What is claimed is:

1. A pixel driving circuit, comprising:

a driving module, configured to drive a light-emitting element to emit light, wherein a control terminal of the driving module is electrically connected to a first node, and a first terminal of the driving module is electrically connected to a second node;

a data writing module, configured to write data signals, wherein a control terminal of the data writing module is electrically connected with a first scan signal line, and a first terminal of the data writing module is electrically connected with a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node, and the coupling module is further configured to perform a voltage division during a light-emitting stage to reduce an effect of data signal caused by an input of a leakage current to a potential of the control terminal of the drive module.

2. The pixel driving circuit according to claim 1, wherein:

the driving module includes a first transistor;

the data writing module includes a second transistor; and the coupling module includes a coupling capacitor, wherein:

a control terminal of the first transistor is electrically connected to the first node, and a first terminal of the first transistor is electrically connected to the second node;

a control terminal of the second transistor is electrically connected to the first scan signal line, a first terminal of the second transistor is electrically connected to the data signal terminal, and a second terminal of the second transistor is electrically connected to a first plate of the coupling capacitor; and a second plate of the coupling capacitor is electrically connected to the second node.

3. The pixel driving circuit according to claim 1, further comprising:

a second reset module, configured to reset the first terminal of the coupling module, wherein:

a control terminal of the second reset module is electrically connected to a third scan signal line;

a first terminal of the second reset module is electrically connected to a second reference voltage signal terminal; and a second terminal of the second reset module is electrically connected to the first terminal of the coupling module.

4. The pixel driving circuit according to claim 3, wherein the second reset module comprises:

a fifth transistor, wherein:

a control terminal of the fifth transistor is electrically connected to the third scan signal line;

a first terminal of the fifth transistor is electrically connected to the second reference voltage signal terminal; and a second terminal of the fifth transistor is electrically connected to the first terminal of the coupling module.

5. The pixel driving circuit according to claim 1, further comprising:

a third reset module, configured to reset the second node using a source voltage signal input from a first source voltage signal terminal, wherein:

a control terminal of the third reset module is electrically connected to a first light-emitting control signal line;

a first terminal of the third reset module is electrically connected to the first source voltage signal terminal; and a second terminal of the third reset module is electrically connected to the second node.

6. The pixel driving circuit according to claim 5, further comprising:

a second light-emitting control module, wherein:

a control terminal of the second light-emitting control module is electrically connected to a second light-emitting control signal line;

a first terminal of the second light-emitting control module is electrically connected to the second terminal of the driving module; and a second terminal of the second light-emitting control module is electrically connected to the first terminal of the light-emitting element.

7. The pixel driving circuit according to claim 1, further comprising:

a third reset module, configured to reset the second node, wherein:

a control terminal of the third reset module is electrically connected to a third scan signal line;

a first terminal of the third reset module is electrically connected to a third reference voltage signal terminal; and a second terminal of the third reset module is electrically connected to the second node.

8. The driving circuit according to claim 7, wherein the third reset module comprises:

a sixth transistor, wherein:

a control terminal of the sixth transistor is electrically connected to the third scan signal line;

a first terminal of the sixth transistor is electrically connected to the third reference voltage signal terminal; and a second terminal of the sixth transistor is electrically connected to the second node.

9. The pixel driving circuit according to claim 7, further comprising:

a first light-emitting control module, wherein:

a control terminal of the first light-emitting control module is electrically connected to a first light-emitting control signal line;

a first terminal of the first light-emitting control module is electrically connected to a first power supply voltage signal terminal; and a second terminal of the first light-emitting control module is electrically connected to the second node; and a second light-emitting control module, wherein:

a control terminal of the second light-emitting control module is electrically connected to the first light-emitting control signal line;

a first terminal of the second light-emitting control module is electrically connected to the second terminal of the driving module; and a second terminal of the second light-emitting control module is electrically connected to the first terminal of the light-emitting element.

10. The pixel driving circuit according to claim 1, further comprising:

a threshold compensation module; and a storage module, configured to maintain a potential of the first node, wherein:

a control terminal of the threshold compensation module is electrically connected to a second scan signal line;

a first terminal of the threshold compensation module is electrically connected to the first node;

a second terminal of the threshold compensation module is electrically connected to a second terminal of the driving module;

a first terminal of the storage module is electrically connected to the first node; and a second terminal of the storage module is electrically connected to a first power supply voltage signal terminal.

11. The pixel driving circuit according to claim 10, wherein:

the threshold compensation module includes a third transistor; and the storage module includes a storage capacitor, wherein:

a control terminal of the third transistor is electrically connected to the second scan signal line;

a first terminal of the third transistor is electrically connected to the first node;

a second terminal of the third transistor is electrically connected to the second terminal of the driving module;

a first plate of the storage capacitor is electrically connected to the first node; and a second plate of the storage capacitor is electrically connected to the first power voltage signal terminal.

12. The pixel driving circuit according to claim 10, further comprising:

a second reset module, configured to reset the first terminal of the coupling module, wherein:

a control terminal of the second reset module is electrically connected to the third scan signal line;

a first terminal of the second reset module is electrically connected to the second terminal of the threshold compensation module; and a second terminal of the second reset module is electrically connected to the first terminal of the coupling module.

13. The pixel driving circuit according to claim 10, further comprising:

a first reset module, configured to reset the first node, wherein:

a control terminal of the first reset module is electrically connected to a third scan signal line;

a first terminal of the first reset module is electrically connected to a first reference voltage signal terminal; and a second terminal of the first reset module is electrically connected to the first node.

14. The pixel driving circuit according to claim 13, wherein the first reset module comprises:

a fourth transistor, wherein:

a control terminal of the fourth transistor is electrically connected to the third scan signal line;

a first terminal of the fourth transistor is electrically connected to the first reference voltage signal terminal; and a second terminal of the fourth transistor is electrically connected to the first node.

15. The pixel driving circuit according to claim 13, further comprising:

a second reset module, configured to reset the first terminal of the coupling module, wherein:

a control terminal of the second reset module is electrically connected to the third scan signal line;

a first terminal of the second reset module is electrically connected to the second reference voltage signal terminal; and a second terminal of the second reset module is electrically connected to the first terminal of the coupling module.

16. The pixel driving circuit according to claim 13, further comprising:

a third reset module, configured to reset the second node, wherein:

a control terminal of the third reset module is electrically connected to the third scan signal line;

a first terminal of the third reset module is electrically connected to the second terminal of the first reset module; and a second terminal of the third reset module is electrically connected to the second node.

17. The pixel driving circuit according to claim 16, further comprising:

a first light-emitting control module, wherein:

a control terminal of the first light-emitting control module is electrically connected to a first light-emitting control signal line;

a first terminal of the first light-emitting control module is electrically connected to a first power supply voltage signal terminal; and a second terminal of the first light-emitting control module is electrically connected to the second node; and a second light-emitting control module, wherein:

a control terminal of the second light-emitting control module is electrically connected to the first light-emitting control signal line;

a first terminal of the second light-emitting control module is electrically connected to the second terminal of the driving module; and a second terminal of the second light-emitting control module is electrically connected to the first terminal of the light-emitting element.

18. A driving method, comprising:

providing a pixel driving circuit, wherein the pixel driving circuit includes:

a driving module, configured to drive a light-emitting element to emit light, wherein a control terminal of the driving module is electrically connected to a first node, and a first terminal of the driving module is electrically connected to a second node;

a data writing module, configured to write data signals, wherein a control terminal of the data writing module is electrically connected with a first scan signal line, and a first terminal of the data writing module is electrically connected with a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node;

in a data writing stage, turning on the data writing module under a control of a first scan signal output by the first scan signal line, and coupling the data signal output by the data signal terminal to the first terminal of the drive module; and in a light-emitting stage, performing a voltage division by the coupling module to reduce an effect of data signal caused by an input of a leakage current to a potential of the control terminal of the drive module.

19. The driving method according to claim 18, wherein the pixel driving circuit further includes a second reset module, the method further comprising:

in an initialization stage, turning on the second reset module under a control of the third scan signal; and resetting the first terminal of the coupling module using a reference voltage signal output by a second reference voltage signal terminal.

20. The driving method according to claim 18, wherein the pixel driving circuit further includes a third reset module, the method further comprising:

in an initialization stage, turning on the third reset module under a control of a third scan signal; and resetting the second node by a reference voltage signal output by the third reference voltage signal terminal.

21. The driving method according to claim 18, wherein the pixel driving circuit further includes a third reset module, a control terminal of the third reset module is electrically connected to a first light-emitting control line, and a first terminal of the third reset module is electrically connected to a first source voltage signal terminal, the method further comprising:

in an initialization stage, turning on the third reset module under a control of a first light-emitting control signal output by the first light-emitting control signal line; and resetting the second node using a first power supply voltage signal output by the first power supply voltage signal terminal.

22. The driving method according to claim 18, wherein the pixel driving circuit further includes a threshold compensation module and a storage module, the method further comprising:

in the data writing stage, turning on the threshold compensation module under a control of a second scan signal output by a second scan signal line;

turning on the driving module under a control of the first node; and maintaining a potential of the first node at a target voltage value by the storage module.

23. The driving method according to claim 22, wherein the pixel driving circuit further includes a second reset module and a first terminal of the second reset module is electrically connected to a second terminal of the threshold compensation module, the method further comprising:

in an initialization stage, turning on the second reset module under a control of the third scan signal;

turning on the threshold compensation module under a control of the second scan signal; and resetting the first terminal of the coupling module by a reference voltage signal output from the second terminal of the threshold compensation module.

24. The driving method according to claim 18, wherein the pixel driving circuit further includes a first reset module, before the data writing stage, the method further comprising:

in an initialization stage, turning on the first reset module under a control of the third scan signal output by a third scan signal line; and resetting the first node using a reference voltage signal output by a first reference voltage signal terminal.

25. The driving method according to claim 24, wherein the pixel driving circuit further includes a second reset module and a first terminal of the second reset module is electrically connected to a second terminal of the first reset module, the method further comprising:

in the initialization stage, turning on the second reset module under the control of the third scan signal; and resetting the first terminal of the coupling module by a reference voltage signal output by the second terminal of the first reset module.

26. The driving method according to claim 24, wherein the pixel driving circuit further includes a third reset module and a first terminal of the third reset module is electrically connected to a second terminal of the first reset module, the method further comprising:

in the initialization stage, turning on the third reset module under a control of the third scan signal; and resetting the second node by the reference voltage signal output by the second terminal of the first reset module.

27. A display device, comprising:

a display panel, wherein the display panel includes:

a pixel driving circuit, wherein the pixel driving circuit includes:

a driving module, configured to drive a light-emitting element to emit light, wherein a control terminal of the driving module is electrically connected to a first node, and a first terminal of the driving module is electrically connected to a second node;

a data writing module, configured to write data signals, wherein a control terminal of the data writing module is electrically connected with a first scan signal line, and a first terminal of the data writing module is electrically connected with a data signal terminal; and a coupling module, configured to couple the data signals to the first terminal of the driving module, wherein a first terminal of the coupling module is electrically connected to a second terminal of the data writing module, and a second terminal of the coupling module is electrically connected to the second node, and the coupling module is further configured to perform a voltage division during a light-emitting stage to reduce an effect of data signal caused by an input of a leakage current to a potential of the control terminal of the drive module.

* * * * *